US010427164B2

(12) United States Patent
Mepham et al.

(10) Patent No.: US 10,427,164 B2
(45) Date of Patent: Oct. 1, 2019

(54) DISCHARGE END WALL INSERTS

(71) Applicant: Polycorp Ltd., Elora (CA)

(72) Inventors: Robert Mepham, Fergus (CA); Pramod Kumar, Waterloo (CA); Robert Michael McPhee, Burlington (CA)

(73) Assignee: Polycorp Ltd., Elora, Ontario (CA)

( * ) Notice: Subject to any disclaimer, the term of this patent is extended or adjusted under 35 U.S.C. 154(b) by 394 days.

(21) Appl. No.: 15/300,878

(22) PCT Filed: Sep. 23, 2015

(86) PCT No.: PCT/CA2015/050940
§ 371 (c)(1),
(2) Date: Sep. 30, 2016

(87) PCT Pub. No.: WO2016/044935
PCT Pub. Date: Mar. 31, 2016

(65) Prior Publication Data

US 2017/0014831 A1 Jan. 19, 2017

Related U.S. Application Data

(60) Provisional application No. 62/054,132, filed on Sep. 23, 2014.

(51) Int. Cl.

| | |
|---|---|
| ***B02C 17/18*** | (2006.01) |
| ***B02C 17/22*** | (2006.01) |
| ***B02C 17/04*** | (2006.01) |
| ***B02C 17/10*** | (2006.01) |

(52) U.S. Cl.
CPC ..... *B02C 17/1855* (2013.01); *B02C 17/04* (2013.01); *B02C 17/10* (2013.01); *B02C 17/183* (2013.01); *B02C 17/1825* (2013.01); *B02C 17/22* (2013.01); *B02C 17/225* (2013.01); *B02C 2210/02* (2013.01)

(58) Field of Classification Search
CPC ... B02C 17/22; B02C 17/225; B02C 17/1835; B02C 17/1855
USPC ..... 241/70, 71, 183, 299
See application file for complete search history.

(56) References Cited

U.S. PATENT DOCUMENTS 4,172,560 A 10/1979 Butler
4,266,733 A * 5/1981 Butler ..... B02C 17/225 241/171

(Continued)

FOREIGN PATENT DOCUMENTS

WO WO2011130781 10/2011

OTHER PUBLICATIONS

International Search Report dated Dec. 3, 2015 for International Application No. PCT/CA2015/050940, published as WO 2016/044935, filed on Sep. 23, 2015.

*Primary Examiner* — Shelley M Self
*Assistant Examiner* — Jared O Brown

(57) ABSTRACT

An insert for covering one or more selected surfaces of a discharge end assembly including a discharge end wall of a mill shell partially defined by an outer perimeter wall thereof and a number of pulp lifters mounted on the discharge end wall. The insert is formed to cover the selected surfaces to mitigate wear to which the selected surfaces are subjected when the insert is located in a predetermined position relative to the selected surfaces.

3 Claims, 19 Drawing Sheets

(56) References Cited

U.S. PATENT DOCUMENTS

| | | | | | |
|---|---|---|---|---|---|
| 4,334,626 | A | * | 6/1982 | Butler | B02C 17/1855 241/171 |
| 4,406,417 | A | | 9/1983 | Jardine et al. | |
| 4,646,980 | A | * | 3/1987 | Player | B02C 17/1855 241/179 |
| 4,848,681 | A | | 7/1989 | Eriksson et al. | |
| 5,055,336 | A | * | 10/1991 | Davis | B65G 11/166 193/2 R |
| 5,161,745 | A | * | 11/1992 | Valeri | B02C 17/1855 241/171 |
| 5,292,077 | A | * | 3/1994 | Inui | B02C 17/06 241/171 |
| 5,361,997 | A | | 11/1994 | Burkes | |
| 5,431,351 | A | | 7/1995 | Lejonklou | |
| 5,472,148 | A | | 12/1995 | Schaeffer | |
| 5,752,665 | A | * | 5/1998 | Wason | B02C 17/225 241/183 |
| 6,663,030 | B2 | | 12/2003 | Washburn et al. | |
| 9,375,722 | B2 | * | 6/2016 | Fernandez | B02C 17/225 |
| 2003/0178516 | A1 | | 9/2003 | Washburn et al. | |
| 2010/0314475 | A1 | | 12/2010 | Allenius et al. | |

* cited by examiner

DISCHARGE END WALL INSERTS

CROSS-REFERENCE TO RELATED APPLICATIONS

This application is the national stage entry of International Patent Application No. PCT/CA2015/050940, filed on Sep. 23, 2015, which claims priority to U.S. Provisional Patent Application No. 62/054,132, filed on Sep. 23, 2014, each of which prior application is incorporated herein by reference. All claims of priority to these applications are hereby made.

FIELD OF THE INVENTION

The present invention is an insert for covering a selected surface of a discharge end assembly including a discharge end wall of a mill shell in a grinding mill.

BACKGROUND OF THE INVENTION

As is well known in the art, various elements of a grinding mill typically are subjected to wear in characteristic patterns, in which certain surfaces of certain elements are subjected to greater wear than other surfaces.

As can be seen in FIGS. 1A-1D, a conventional discharge wall assembly 20 in a typical grinding mill 21 (FIG. 1D) includes a number of vanes or pulp lifters 22 (FIGS. 1A-1C) that extend inwardly (i.e., toward a central hole 24) from a shell wall or outer perimeter wall 26 of a mill shell 23. The vanes or pulp lifters 22 are at least partially mounted on a discharge end wall 27. The vanes are intended to direct pulp including ore particles and water to the central hole 24, through which the pulp exits the grinding mill. In the example illustrated in FIGS. 1A-1C, the vanes 22 include shorter and longer vanes. As is well known in the art, various arrangements of longer and shorter vanes, and possible additional vanes of intermediate length (not shown in FIGS. 1A-1C), may be used. The optimum design depends on a number of parameters, e.g., the hardness of the ore, and the unit cost of energy inputs, as is also known.

As is well known in the art, the vanes or pulp lifters 22, the outer perimeter wall 26, and the discharge end wall 27, at least partially define the pulp chambers 28 therebetween. Typically, discharge grates "DG" (FIG. 1D) are located on the pulp chambers 28 to screen the flow of slurry or pulp into the pulp chambers, i.e., to limit the solid particles in the slurry or pulp entering the pulp chambers to particles sized smaller than the apertures in the grates.

It will be understood that the majority of the solid particles in the pulp (i.e., primarily ore that has been ground), which exit the pulp chambers via the central hole 24, are omitted from FIGS. 1A-1C for clarity of illustration. As is well known in the art, the slurry or pulp is a heterogeneous mixture of solid particles and water. Some finer particles may be suspended in the water. The ore and the ore particles typically include some waste material.

As is well known in the art, the mill shell 23 of the grinding mill 21 defines a mill shell chamber 25 upstream from the pulp chambers, and the mill shell 23 is rotatable about an axis of rotation "AX" (FIG. 1D). When the grinding mill is operating, a charge "CH" is located in the mill shell chamber 25. The charge (i.e., ore, water, and grinding media, if grinding media are used) may fill the mill shell chamber up to a level indicated by a line "A" in FIGS. 1A-1D. The direction of rotation of the mill shell 23 is indicated by arrow "B" in FIGS. 1A-1C. Typically, the ore is added into the grinding mill at an input end (as schematically represented by arrow "IN" in FIG. 1D), and water is also added into the grinding mill. The charge is rotated as the mill shell of the grinding mill rotates, subjecting the ore to comminution and resulting in finely-ground ore particles that are included in a slurry that is passed to an output, or discharge, end of the grinding mill. The movement of the ore particles and water through the discharge grates "DG" and into the pulp chambers is schematically represented by arrows "OP" in FIG. 1D. As the mill shell rotates, the pulp chambers are also rotated.

As each of the pulp chambers is immersed in the charge in turn, the slurry flows into each pulp chamber successively. As can be seen in FIGS. 1A-1C, depending on the amount of the charge in the mill shell chamber, a pulp chamber may be immersed (in whole or in part) as it is rotated from about the three o'clock position to about the nine o'clock position. When the pulp chambers are rotated to be above the charge, the pulp in them partially exits (i.e., is partially discharged). As a pulp chamber is moved from about the nine o'clock position to about the three o'clock position (i.e., when it is located above the line designated "A"), the pulp in that pulp chamber is directed by gravity toward the central hole by the vanes that partially define that pulp chamber (i.e., one such vane being located on each side of the pulp chamber).

The vanes or pulp lifters also support the pulp that is positioned on them respectively, and direct the pulp toward the central hole, when the vanes are rotated through positions above the charge. The movement of the pulp from the pulp chambers and into the central hole 24 is schematically represented by arrow "EX" in FIG. 1D.

As is also well known in the art, due to the concentration of wear on certain surfaces of certain elements, the elements may need to be replaced, even though other parts of the elements have been subjected to relatively little wear. The result is that significant costs may be incurred due to excessive wear that is concentrated in a relatively small area of a surface of an element. First, costs are incurred in connection with purchasing a new element, e.g., all or part of a vane or pulp lifter. Second, costs are also incurred in connection with the replaced element, e.g., although the replaced element may be worn in only a small portion thereof, it is prematurely replaced, as other portions of the elements may not be worn out. Third, significant costs are incurred due to the downtime required to replace an element that is prematurely worn.

For example, the characteristic movements of certain of the ore particles in the pulp in the pulp chambers are illustrated in FIGS. 1A-1C. It is believed that at least some of the wear to which the elements forming the pulp chambers is subjected is due to the movement of carryover pulp.

It will be understood that the top surface of the charge (identified as "A" in FIGS. 1A-1D) typically varies significantly, depending on a number of parameters, and the level illustrated in FIGS. 1A-1D is exemplary only. (As will be described, embodiments of the invention are illustrated in the balance of the attached drawings.) In addition, those skilled in the art would appreciate that the direction of rotation may be clockwise or counter-clockwise, depending on how the mill is manufactured and installed.

"Carryover" of pulp in grinding mills (i.e., the incomplete discharge of pulp in pulp chambers within one revolution of a mill shell) is a serious problem. The extent of carryover may be as high as 50% or more, depending on the circumstances. Carryover imposes many costs on the operator. In particular, it appears that some of the wear to which the elements mounted on the discharge end wall are subjected is due to carryover.

As is well known in the art, ideally, all the pulp in a particular pulp chamber should empty out of that pulp chamber 28 in the time that such pulp chamber 28 is moved from approximately the nine o'clock position to approximately the three o'clock position. That is, ideally, the pulp chamber should be fully emptied before it is next re-immersed in the charge. However, in practice, it often happens that a significant portion of the pulp does not exit the pulp chamber by the time that the pulp chamber has reached the three o'clock position. The pulp remaining in the pulp chamber, at a point when it ideally all should have been discharged via the central hole, is typically referred to as "carryover".

The movement of the pulp that is carried over is schematically illustrated in FIGS. 1A-1C. It will be understood that the illustrations in FIGS. 1A-1C are based on computer-generated graphic simulations of the movement of the pulp in the pulp chambers as the mill shell rotates.

The reasons for carryover are well-known in the art. The relatively high mill shell rotation speed, e.g., about 10 rpm, is an important factor. This relatively fast rotation speed means that the discharge wall 27 completes one rotation every six seconds. Accordingly, the pulp in a particular pulp chamber has only approximately three seconds, at most, to exit the pulp chamber 28, i.e., to be moved to the central hole 24 and to exit therethrough. In addition, due to the rotation of the mill shell, the pulp in each pulp chamber is urged outwardly by centrifugal force, i.e., away from the central hole 24, effectively slowing the exit of the pulp from the pulp chamber as the pulp chamber moves from approximately the nine o'clock position to approximately the three o'clock position.

It has been determined that the movement of the pulp that is carried over, inside the pulp chamber, is distinctive to the specific grinding mill, and generally consistent. Because of this, the elements of the discharge wall assembly 20 in a particular mill are generally subjected to wear in substantially consistent patterns over time. However, the wear is not necessarily uniform over different pulp chambers in a particular mill, for reasons that are unclear. For example, one pulp chamber may be subject to excessive wear in the outer region thereof (i.e., proximal to the outer perimeter), and the pulp chambers adjacent thereto may not be subjected to excessive wear, or may be subjected to excessive wear in other areas thereof.

For example, in FIG. 1A, pulp chambers identified for convenience by reference numerals 28A-28E are shown with ore particles 30 of the pulp therein. (It will be understood that only a portion of the ore particles that are in the pulp chambers are illustrated in FIGS. 1A-1C, for clarity of illustration. Also, the water in the pulp is omitted from FIGS. 1A-1C, for clarity of illustration.) As can be seen in FIG. 1A, as an example, pulp chamber 28A is partially defined between a pair of the vanes or pulp lifters identified for convenience by reference numerals 122 and 122A, which are the trailing and leading vanes respectively, relative to the direction of rotation. When the pulp chamber 28A is in the one o'clock position, the solid particles 30 start to fall from a leading edge 132 of the vane 122 (FIG. 1A).

In pulp chamber 28B, partially defined between a pair of the vanes identified in FIG. 1A for convenience as 122A and 122B, the movement of the solid particles 30 toward a trailing side 134B of the leading vane 122B is more pronounced, because the pulp chamber 28B as illustrated is further along the clockwise rotation than the pulp chamber 28A. (It will be understood that of the pair of the vanes that define the pulp chamber 28B, the vane 122A is the trailing vane, and the vane 122B is the leading vane.)

In FIGS. 1A and 1B, pulp chambers 28C, 28D, and 28E show the solid particles 30 progressively moved further onto the trailing edge of the leading vane in each pulp chamber respectively, due to the changing positions of the pulp chambers as the mill shell rotates and the effects of gravity on the solid particles 30. In particular, in FIGS. 1A and 1B, it can be seen that, in the pulp chambers 28D, 28E (located at the three o'clock position, or almost at such position) the particles 30 that will be carryover are positioned in a middle area 35 of the trailing edge 134 of the leading pulp lifter, and they are spaced apart from the shell wall 26 by a distance 36 (FIG. 1B).

As can be seen in FIG. 1C, the ore particles 30 move downwardly, to pile on the shell wall 26, when the pulp chambers are at or close to the six o'clock position. Those skilled in the art would also appreciate that the slurry that flows into the pulp chambers, to fill them when the pulp chambers are positioned below the surface of the charge is also omitted from FIGS. 1A-1C. It will be understood that, although omitted, the pulp (the ore particles and water) quickly fill the immersed pulp chambers.

It can be seen in FIGS. 1A-1C that, although the solid particles 30 in a particular pulp chamber have been moved part of the distance toward the central hole when the pulp chambers are at approximately the three o'clock position or prior thereto, the particles 30 that are illustrated as becoming carryover do not reach the central hole.

The particles 30 that are destined to become carryover in the illustrated example are, at one point while the mill shell rotates, generally located in the middle area 35 of the pulp lifter, i.e., they are temporarily located a relatively short distance from the central hole. From FIGS. 1A and 1B, it can be seen that the particles 30 have moved from the shell wall 26 to the middle area 35 as the pulp chamber 28 in which the particles 30 are located has moved from approximately the nine o'clock position to approximately the three o'clock position. However, because the particles 30 that are illustrated have not reached the central hole 24 when the pulp chamber they are in is at the three o'clock position, they are returned to engage the outer perimeter wall 26 as the pulp chamber in which they are located moves further (clockwise) from approximately the three o'clock position. For these particles 30, the gains achieved during this rotation (i.e., the distances moved toward the central hole) are lost when the pulp chamber moves past the three o'clock position.

It will also be appreciated that the carried-over solid particles 30 move to the outer wall 26 when the pulp chamber(s) in which they are located is next re-immersed in the charge, as illustrated in FIG. 1C. The carried-over particles 30 will only exit the mill (i.e., via the central hole 24) in the next rotation if such solid particles reach the central hole during such rotation. Accordingly, it can be seen that some of the pulp that is carried over to the subsequent rotation may be carried over for several rotations.

In FIGS. 1A-1C, it can also be seen that the carryover of the ore particles 30 results in increased wear on certain portions of the pulp lifters 22, and also on the shell wall 26. For instance, in FIG. 1A, the solid particles 30 of the carryover fall from the leading side 132 of the pulp lifter 122, and such particles 30 engage the trailing side 134 of the adjacent pulp lifter 122A. In this way, a portion "C" of the trailing edge of each leading pulp lifter is subjected to wear due to the solid particles 30 that are carried over, by the sliding movement of the ore particles on the portion "C".

The portion "C" is generally spaced apart from the shell wall 26, i.e., the portion "C" is generally at the intermediate part 35 of the pulp lifter.

It can also be seen in FIG. 1A that the trailing side 134 of the pulp lifter 122 is subjected to impact (or dynamic) loading of the ore particles 30 onto the trailing side 134 of the pulp lifter, at a location on the trailing side 134 identified as "I" in FIG. 1A.

As can be seen in FIG. 1C, the solid particles 30 that are carried over tend to accumulate in the pulp chamber 28 on the mill shell wall 26, when the pulp chamber 28 is at or near the six o'clock position. (As noted above, other ore particles moved into the pulp chambers when they are immersed in the charge are omitted from FIGS. 1A-1C for clarity of illustration.) The portions "$D_1$", "$D_2$" of the pulp lifters partially defining the pulp chamber that are proximal to the mill shell wall 26 may also be subjected to wear due to carryover, as are the portions of the mill shell "E" (FIG. 1C) that partially defines the pulp chamber 28.

In FIG. 1A, certain ore particles that are not destined to be included in carryover are also illustrated, identified by the reference numeral 31. The ore particles 31 move downwardly toward the central hole 24, as schematically represented by arrows "J" in FIG. 1A. However, due to the lengths of adjacent pulp lifters, those pulp lifters are subjected to impact loading of the ore particles onto the trailing side 134 of the pulp lifters 22, at locations on the trailing sides 134 identified as "K" in FIG. 1A. Accordingly, as illustrated, the pulp lifters are subjected to excess wear proximal to their respective inner ends, at "K".

SUMMARY OF THE INVENTION

There is a need for a discharge wall insert that overcomes or mitigates one or more of the defects or disadvantages of the prior art. Such disadvantages or defects are not necessarily included in those listed above.

In its broad aspect, the invention provides a discharge end wall system mounted on a discharge end wall of a mill shell in a grinding mill, the mill shell being rotatable about an axis of rotation thereof in a direction of rotation to produce a pulp including ore particles and water. The discharge end wall is partially defined by an outer perimeter wall of the mill shell and includes a central hole through which the pulp exits the mill shell. The discharge wall system includes a discharge end assembly having the discharge end wall and the outer perimeter wall, and a number of pulp lifters radially arranged on the discharge end wall relative to the axis of rotation. Pairs of adjacent ones of the pulp lifters each respectively include a leading one of the pulp lifters in the pair and a trailing one of the pulp lifters in the pair relative to the direction of rotation. The pairs partially defining respective pulp chambers therebetween through which the pulp is at least partially directed to the central hole. The discharge wall system also includes one or more at inserts for covering at least one selected surface of the discharge end assembly, to mitigate the extent to which the selected surface is subjected to wear due to movement of the pulp in the pulp chambers.

In another of its aspects, the invention provides a grinding mill including a mill shell having a mill shell chamber therein and having an outer perimeter wall partially defining a discharge end wall of the mill shell, rotatable in a direction of rotation to produce a pulp including ore particles and water. The discharge end wall has a central hole therein through which the pulp exits the mill shell. The grinding mill also includes a discharge wall assembly having the discharge end wall and the outer perimeter wall, and a number of pulp lifters mounted on the discharge end wall. Pairs of adjacent ones of the pulp lifters respectively include a leading one of the pulp lifters in the pair and a trailing one of the pulp lifters in the pair relative to the direction of rotation, the pairs partially defining respective pulp chambers therebetween through which the pulp is at least partially directed to the central hole. In addition, the grinding mill includes one or more inserts for covering one or more selected surfaces of the discharge wall assembly, to mitigate wear to which the selected surface is subjected by movement of the pulp in the pulp chambers.

In yet another of its aspects, the invention provides a method of installing one or more inserts in a discharge end assembly including a discharge end wall of a mill shell, the mill shell defining a mill shell chamber therein. The method includes the steps of selecting one or more selected surfaces in the discharge end assembly that is subjected to wear, and forming the insert to cover the selected surface when positioned in a predetermined position relative to the selected surface, to mitigate the wear to which the selected surface is subjected. One or more discharge grates positioned between the mill shell chamber and the discharge end assembly are removed, to expose the selected surface. The insert is positioned in the predetermined position to cover the selected surface. Finally, the insert is secured in the predetermined position on the discharge end wall assembly.

In another of its aspects, the invention provides an insert for covering one or more selected surfaces of a discharge end assembly including a discharge end wall of a mill shell partially defined by an outer perimeter wall thereof and a plurality of pulp lifters mounted on the discharge end wall. The insert is formed to cover the selected surface to mitigate wear to which the selected surface is subjected when the insert is located in a predetermined position relative to the selected surface.

In another aspect, the invention provides an insert formed to be positioned in a predetermined position relative to a pulp chamber at least partially defined by leading and trailing sides of trailing and leading pulp lifters respectively, a discharge end wall, and an outer perimeter wall. The pulp chamber is formed to direct pulp including ore particles and water therethrough. The insert includes a floor, for covering a preselected part of the discharge end wall, one or more sidewalls connected to the floor, for covering predetermined parts of the leading and trailing sides of the respective trailing and leading pulp lifters. In addition, the insert includes an end wall, for covering the shell wall. The insert is formed to mitigate the extent to which the preselected part of the discharge end wall, the predetermined parts of the leading and trailing sides of the trailing and leading pulp lifters respectively, and the part of the outer perimeter wall are subjected to wear due to movement of the pulp in the pulp chamber when the insert is positioned in the predetermined position.

BRIEF DESCRIPTION OF THE DRAWINGS

The invention will be better understood with reference to the attached drawings, in which.

DETAILED DESCRIPTION

Figure 1A:
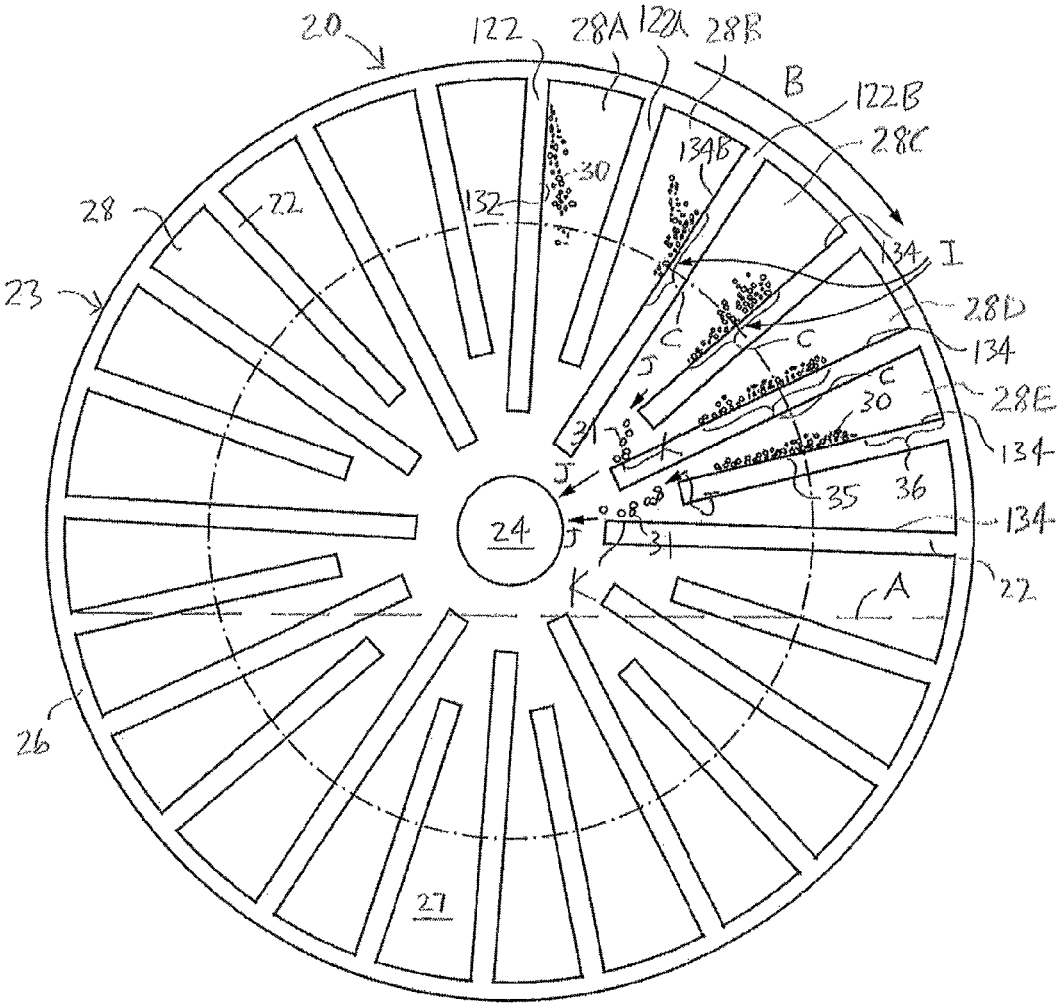
FIG. 1A (Prior Art)
FIG. 1A (also described previously) is a schematic illustration showing certain selected solid particles in selected pulp chambers located at first locations between the nine o'clock and three o'clock positions thereof and moving along a clockwise rotation path.

In the attached drawings, like reference numerals designate corresponding elements throughout. In particular, to simplify the description, the reference numerals previously used in FIGS. 1A-1D are used again in connection with the description of the invention hereinafter, except that each such reference numeral is raised by 100 (or by whole number multiples thereof, as the case may be), where the elements described correspond to elements referred to above.

Reference is first made to FIGS. 2A-7 to describe an embodiment of a discharge end wall system 240 mounted on a discharge end wall 227 of a mill shell 223 in a grinding mill 221, the mill shell 223 being rotatable about an axis of rotation thereof "$AX_1$" in a direction of rotation to produce the pulp including ore particles and water. The discharge end wall 227 is partially defined by an outer perimeter wall 226 of the mill shell 223 and includes a central hole 224 through which the pulp exits the mill shell 223. In one embodiment, the discharge wall system 240 preferably includes a discharge end assembly 242 that includes the discharge end wall 227 and the outer perimeter wall 226 and a number of pulp lifters 222 radially arranged on the discharge end wall 226 relative to the axis of rotation "$AX_1$". It is preferred that pairs of adjacent ones of the pulp lifters each respectively include a leading one of the pulp lifters in the pair and a trailing one of the pulp lifters in the pair relative to the direction of rotation, as will be described. The pairs of pulp lifters partially define respective pulp chambers 228 therebetween through which the pulp is at least partially directed to the central hole 224. Preferably, the discharge end wall system 240 also includes one or more inserts 244 for covering one or more selected surfaces 246 (FIG. 4C) of the discharge end assembly 242, to mitigate the extent to which the selected surface 246 is subjected to wear due to movement of the pulp in the pulp chambers 228, as will also be described.

Figure 4A:
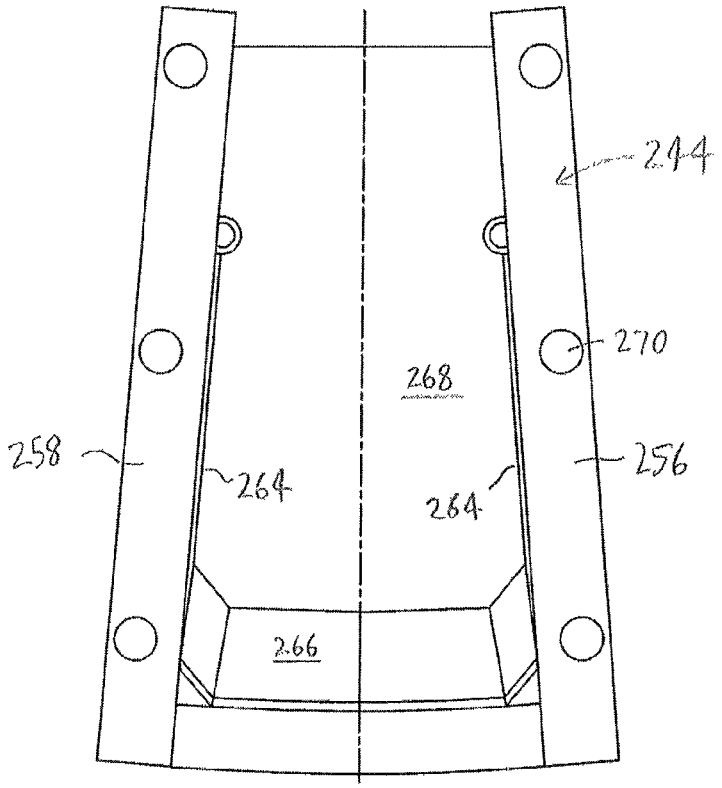
FIG. 4A is a top view of an embodiment of an insert of the invention, drawn at a larger scale.
Figure 4B:
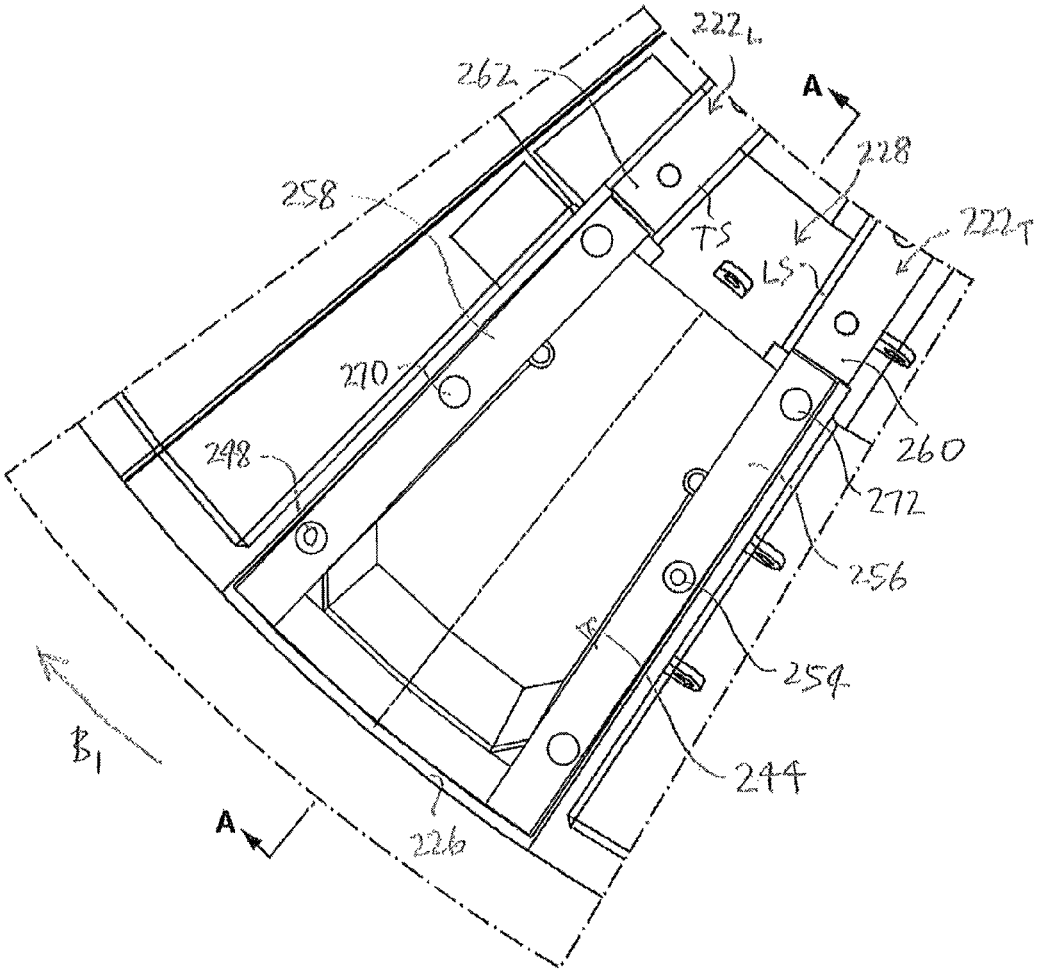
FIG. 4B is an elevation view of a portion of an embodiment of a discharge end wall assembly of the invention including the insert of FIG. 4A, drawn at a smaller scale.
Figure 4C:
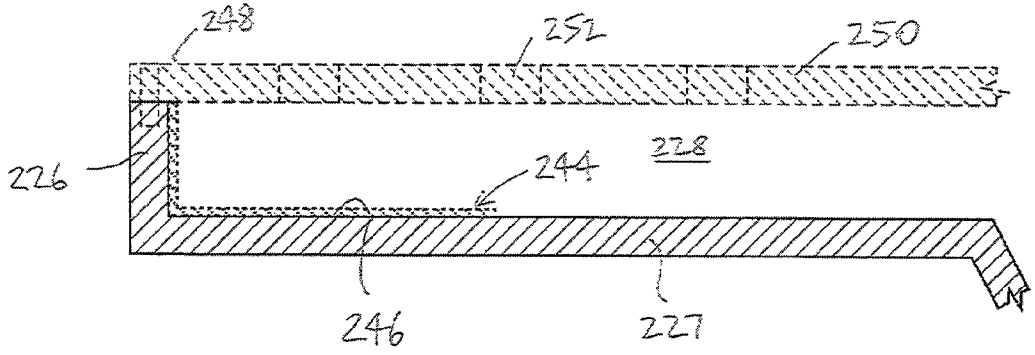
FIG. 4C is a cross-section taken along line A-A in FIG. 4B.

As can be seen, for example, in FIGS. 4A-4C, it is also preferred that the discharge end wall system 240 includes means 248 for securing the insert 244 in a predetermined position relative to the selected surface 246, to cover the selected surface 246.

In one embodiment, the discharge end wall system 240 preferably also includes one or more discharge grates 250 (FIG. 4C) positioned on the pulp chambers 228. The discharge grates 250 include apertures 252 therein to permit the ore particles and the water to flow therethrough into the pulp chambers 228. It is preferred that the insert 244 is securable in the predetermined position relative to the selected surface 246 between the discharge grate 250 and the discharge end assembly 242, to cover the selected surface 246 (FIG. 4C). In one embodiment, therefore, the means 248 preferably includes the discharge grate 250 and the fasteners 254. In FIG. 4B, for instance, the insert 244 is shown installed in the pulp chamber 228, and one of the fasteners 254 is shown in place. It will be understood that the discharge grate 250 is omitted from FIG. 4C for clarity of illustration.

In one embodiment, the insert 244 preferably is formed to be positioned in at least part of a selected one of the pulp chambers 228 to cover the selected surface 246 (FIGS. 4B, 4C). As can be seen in FIG. 4B, the pulp chamber 228 preferably is at least partially defined by a pair of pulp lifters. The direction of rotation is indicated by arrow "$B_1$". For clarity of illustration, the leading one of the pair of pulp lifters partially defining the pulp chamber 228 illustrated in FIG. 4B is identified in FIG. 4B by reference numeral $\mathbf{222}_L$, and the trailing one of the pair is identified by reference numeral $\mathbf{222}_T$.

As noted above, it has been found that the extent to which the pulp chambers in the discharge end wall in a particular grinding mill are subjected to wear varies. This is believed to be due to a number of factors, including, for example, the arrangements of pulp lifters of different lengths. Because the wear to which the pulp chambers are subjected generally varies significantly, the optimum designs of the inserts and their optimum distribution or positioning in the discharge end assembly 242 may vary widely. Preferably, the design of each insert 244 is based on the pattern of wear in the pulp chamber in which the insert is to be installed, as will be described.

In addition, because the patterns of wear in each part of the discharge end assembly 242 vary, it is preferred that the inserts 244 are individually formed, or tailored, to cover specifically identified selected surfaces 246. For instance, the wear in two adjacent pulp chambers may be sufficient to require pulp chamber inserts in each, however, if the wear patterns in each of the two pulp chambers are different (as is often the case), then the inserts formed to cover the selected surfaces in each of the two pulp chambers also are formed or tailored to have different configurations or shapes, and they are also formed to be secured into different predetermined positions respectively.

As can be seen in FIGS. 4B and 4C, the pulp chamber insert 244 preferably is secured in place by the discharge grate 250 that is secured to the discharge end assembly 242 by fasteners 254. That is, the pulp chamber insert 244 preferably is held in the predetermined position therefor (i.e., so that the insert 244 covers the selected surface 246) by the fasteners that hold discharge grate(s) in position on the discharge end assembly 242. In one embodiment, the pulp chamber insert 244 preferably includes flanges 256, 258 that engage ridge surfaces 260, 262 of the pulp lifters 228 (FIG. 4B). Preferably, the flanges 256, 258 are secured to, or integrally formed with, sidewalls 264 of the insert 244.

It will be understood that, in order to install the pulp chamber insert 244 once it is formed, it is positioned in a preselected part of the pulp chamber 228 (FIG. 4B). Preferably, the pulp chamber insert 244 is formed and sized to fit in the preselected part. The insert 244 is formed and positioned to cover the selected surface 246, and it will be understood that, in FIGS. 4B and 4C, the selected surface 246 is at least a portion of the part of the pulp chamber 228 that is covered by the pulp chamber insert 244. Preferably, the pulp chamber's floor is a part of the discharge end wall 227. The outer perimeter wall 226 also partially defines the pulp chamber 228, as do the trailing side "TS" of the leading pulp lifter $\mathbf{222}_L$ and the leading side "LS" of the trailing pulp lifter $\mathbf{222}_L$ (FIG. 4B).

In one embodiment, the pulp chamber insert 244 preferably includes one or more end walls 266 and a floor portion 268 connected to the sidewalls 264 (FIG. 4A). As will be described, because the form of the pulp chamber insert is determined according to the position and shape of the selected surfaces that are to be covered, other embodiments of the pulp chamber insert may have other forms.

When the floor portion 268 of the pulp chamber insert 244 is positioned on the discharge end wall 227, the end wall 266 preferably engages the outer perimeter wall 226. Also, in such position, the sidewalls 264 of the pulp chamber insert 244 preferably engage the leading and trailing sides "LS", "TS" of the trailing and leading pulp lifters $\mathbf{222}_T$, $\mathbf{222}_L$respectively. In addition, and as can be seen in FIG. 4B, when the pulp chamber insert 244 is so positioned in the part of the pulp chamber 228, it is preferred that the flanges 256, 258 engage the ridge surfaces 260, 262 of the trailing and leading pulp lifters $\mathbf{222}_T$, $\mathbf{222}_L$ respectively.

From the foregoing, it can be seen that the pulp chamber insert 244 is formed to fit into the pulp chamber 228 so that its parts engage corresponding elements at least partially defining the pulp chamber 228, to locate the pulp chamber insert 244 so that it covers the selected surface(s) 246 when the insert 244 is in its predetermined position relative to the selected surface(s) 246. The pulp chamber insert 244 preferably is tailored to address the patterns of wear, whether resulting from carryover or otherwise.

As can also be seen in FIG. 4B, in one embodiment, the flanges 256, 258 preferably include openings 270 formed for alignment with holes 272 in the ridge surfaces 260, 262. It will be understood that the holes 270 and the holes 272 are shown aligned in FIG. 4B. It will also be understood that the holes 272 preferably are also aligned with additional holes (not shown) in the grates 250 through which fasteners 254 are insertable, to secure the grates 250 to the ridge surfaces of the pulp lifters $\mathbf{222}_T$, $\mathbf{222}_L$ respectively. Based on the foregoing, it can be seen that the flanges 256, 258 are positioned between the ridge surfaces of the pulp lifters and the grates and are held in place between the grates and the ridge surfaces by the fasteners.

Preferably, the pulp chamber insert 244 is made of any suitable material or materials, preferably selected at least in part for their ability to resist the wear to which the pulp chamber insert is subjected by the solid particles in the pulp, i.e., both carryover and non-carryover. It will be understood that the pulp chamber insert 244 may be made of highly wear-resistant material or materials. For example, the wear-resistant material or materials may be any suitable metallic or non-metallic material or materials. The insert also may be any suitable thickness or thicknesses. In each grinding mill, the parameters may differ widely, and the optimum thicknesses of material for any particular pulp chamber insert is determined according to a number of factors specific to the mill. As will be described, in one embodiment, the thicknesses of different portions of the pulp chamber insert may also vary, in order to take into account patterns of wear in the respective pulp chambers.

From the foregoing, it can be seen that, when the pulp chamber insert 244 is in the predetermined position therefor, the pulp chamber insert 244 protects selected surfaces 246 of the pulp lifters and the elements that, at least partially, define the pulp chamber in which the insert is positioned.

One of the advantages of the pulp chamber insert is that it may be installed when the discharge grates are replaced. Those skilled in the art would be aware that the discharge grates generally are replaced more frequently than, e.g., the pulp lifters. From the foregoing, it can be seen that the pulp chamber inserts 244 may be installed economically at a time when the grinding mill 221 is down for replacement of the discharge grates. Because of this, the inserts 244 may be installed without such installation imposing significant additional downtime (i.e., additional expense) beyond the downtime required for replacement of discharge grates.

The pulp chamber insert 244 of the invention also has the advantage that the insert 244 preferably is held in place by the fasteners that secure the grates to the pulp lifters. Accordingly, the insert 244 preferably may be retrofitted relatively easily, being held in the predetermined position therefor using the fasteners previously used only to secure the discharge grates to the discharge end assembly 242.

Figure 7:
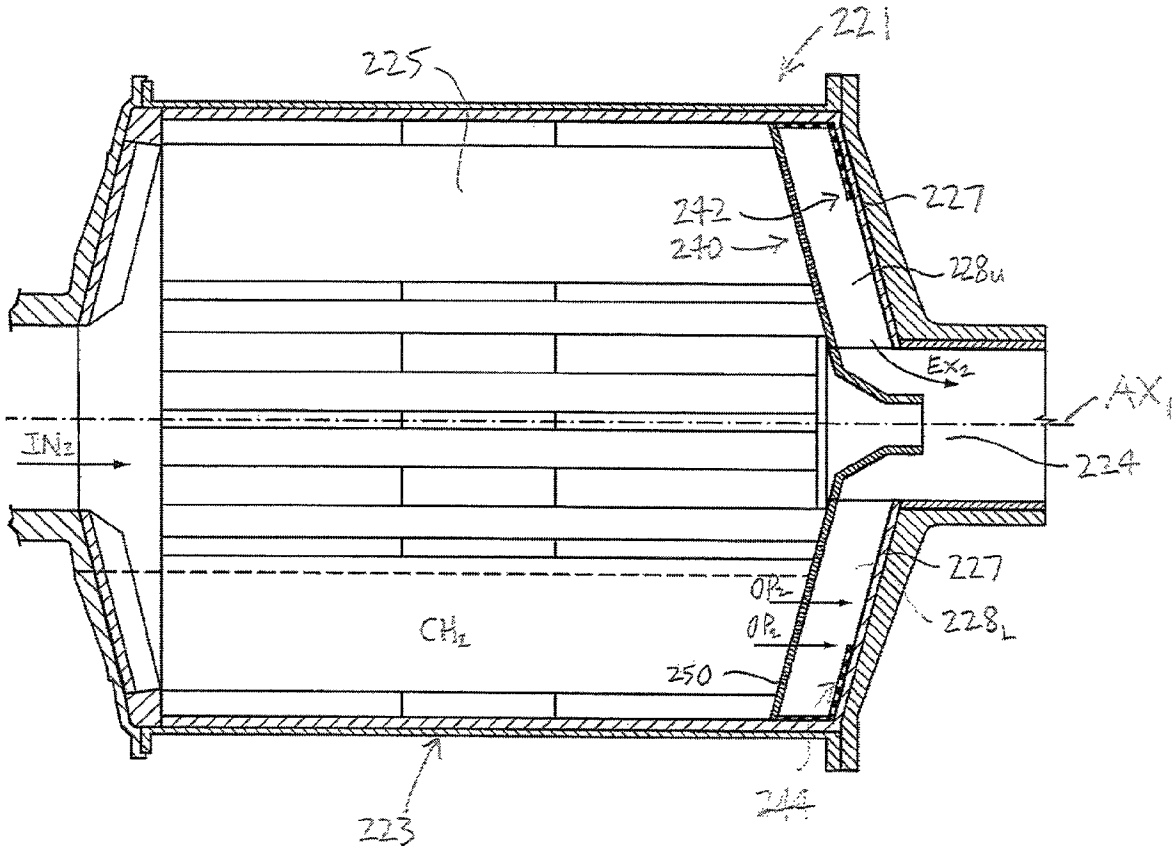
FIG. 7 is a longitudinal cross-section of an embodiment of a grinding mill of the invention, drawn at a smaller scale.

As can be seen in FIG. 7, in one embodiment, the grinding mill 221 preferably includes the pulp chamber inserts 244 installed in selected ones of the pulp chambers 228, as described above. From the foregoing, it will be understood that the pulp chamber inserts installed in the grinding mill 221 are not necessarily the same, but instead each preferably is formed for use in a specific pulp chamber, to address the individual patterns of wear in each pulp chamber. Also, and as described above, the patterns of wear may be such that certain pulp chambers do not have pulp chamber inserts installed therein, as there may be insufficient wear in such pulp chambers to warrant pulp chamber inserts therein. As illustrated in FIG. 7, as an example, the pulp chamber inserts 244 are installed in pulp chambers identified for convenience as $\mathbf{228}_U$ and $\mathbf{228}_L$.

As can be seen in FIG. 7, in use, a charge "$CH_2$" preferably is introduced into a mill shell chamber 225 of the mill shell 223, as indicated by arrow "$IN_2$". The top surface of the charge "$CH_2$" is indicated at "$A_2$". As is known, the grinding mill 221 preferably includes the mill shell 223 rotatable about the axis "$AX_1$" (FIG. 7). As the mill shell 223 rotates, the ore in the charge is ground into finer ore particles that are included in the pulp that is ultimately located in the pulp chambers 228, as indicated by arrows "$OP_2$" in FIG. 7. (Those skilled in the art would appreciate that the ore and the ore particles may include waste and waste particles.) Subject to carryover, the pulp exits the grinding mill 221 via the central hole 224 in the discharge end wall 227, as indicated by arrow "$EX_2$" in FIG. 7.

Preferably, the pattern of wear in a particular pulp chamber is taken into account in the design of the pulp chamber insert that is to be installed in that pulp chamber. For example, a sidewall's thickness may be increased in a portion thereof if excessive wear were found on the corresponding portion of the wall of the pulp chamber. It will be understood that other parameters (e.g., expected tph throughput, speed of rotation) preferably are also taken into account in the pulp chamber insert design, particularly if any such parameters are expected to be changed.

Figure 2A:
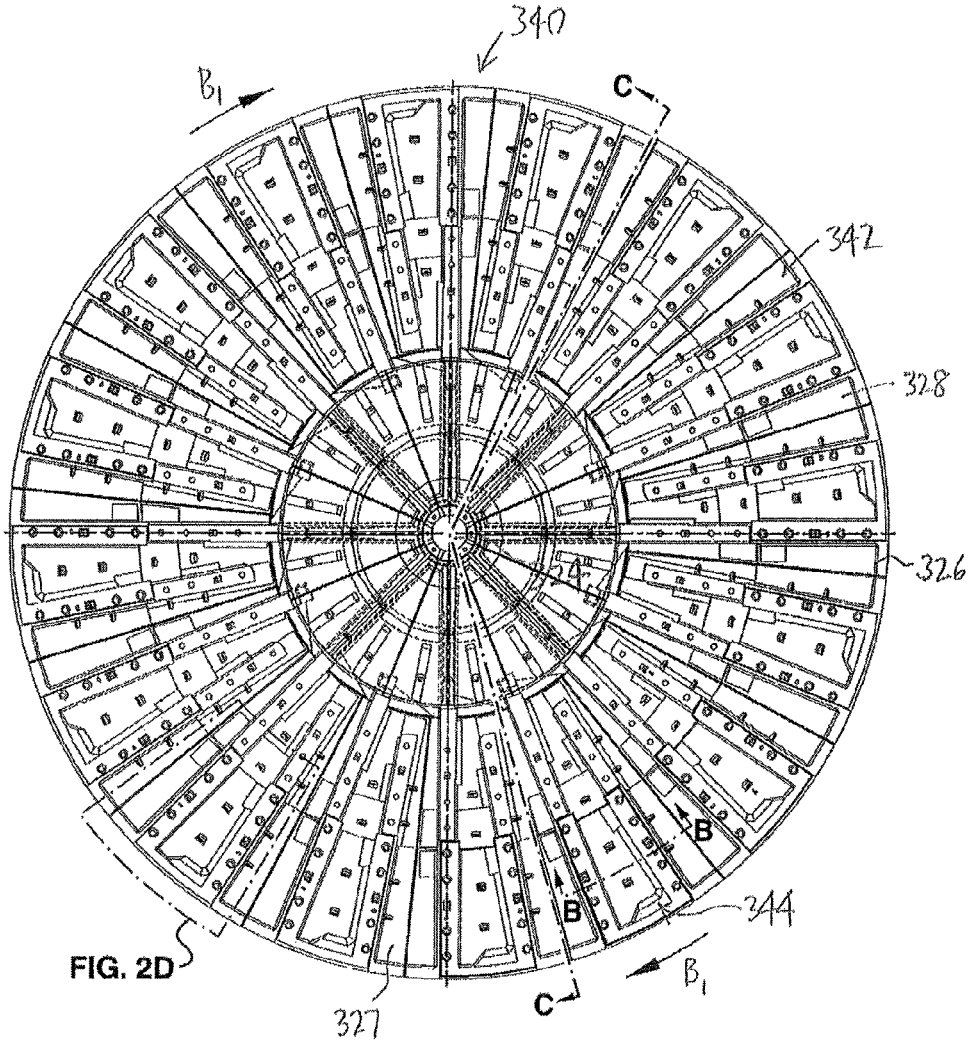
FIG. 2A is an elevation view of an embodiment of a discharge end wall system of the invention including an embodiment of a pulp chamber insert of the invention, drawn at a larger scale.
Figure 4D:
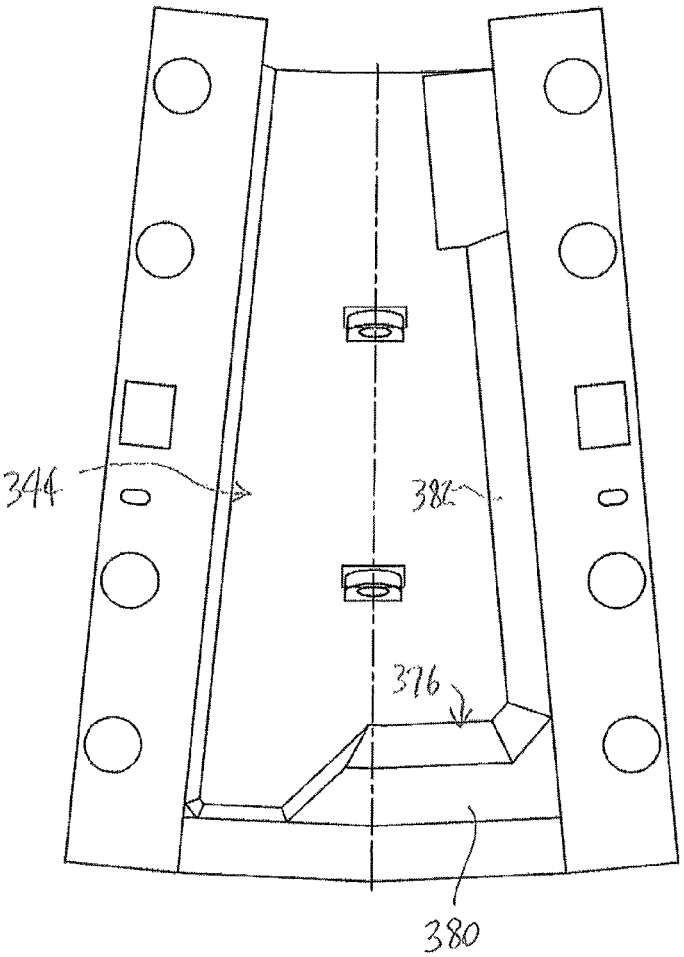
FIG. 4D is a top view of an alternative embodiment of the insert of the invention, drawn at a larger scale.

In an alternative embodiment, an insert 344 of the invention preferably additionally includes one or more cushion elements 376 formed to be positioned adjacent to one or more preselected portions 378 of a selected surface 346 (FIG. 2B) when the insert 344 is positioned in the predetermined position therefor, to attenuate the extent to which the selected portion 378 is subjected to wear. The insert 344 is shown in FIG. 4D. A discharge end wall system 340 including the insert 344 is illustrated in FIG. 2A.

Figure 5:
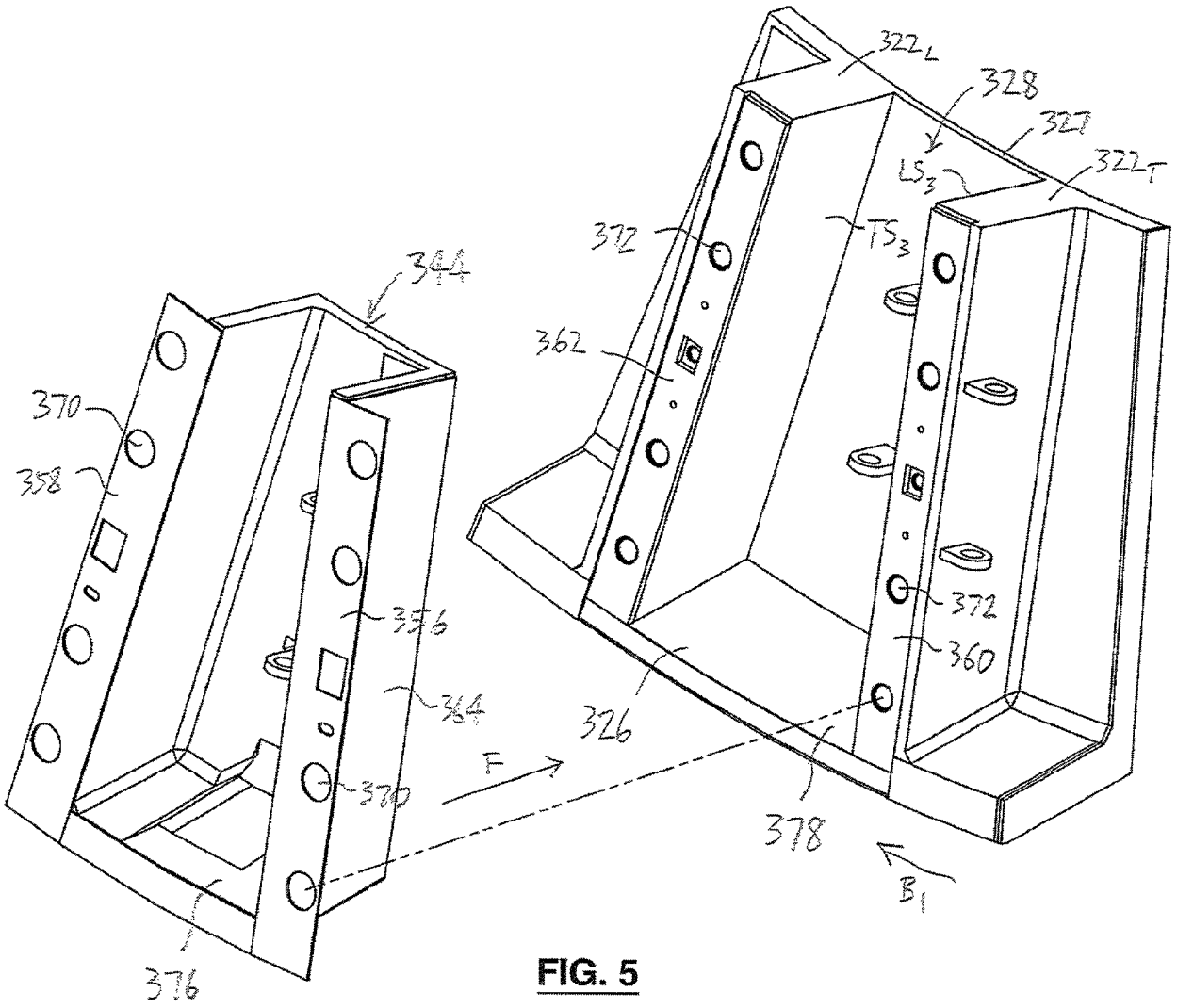
FIG. 5 is an exploded isometric view of the insert of FIG. 4C and a portion of a pulp chamber in which the insert is positionable.

For instance, the insert 344 may include portions thereof that are selectively thickened or otherwise formed to provide protection from wear to specific parts of the elements that partially define the pulp chamber 328 (FIG. 5). The thickened portions preferably are shaped and positioned to correspond to patterns of wear inside the pulp chambers respectively, and are referred to herein as the cushion elements. As can be seen, for instance, in FIG. 4D, in one embodiment, the insert 344 preferably includes an end wall cushioning element 380 formed to provide extra protection to the outer wall 326 of the pulp chamber 328 (FIG. 5). This embodiment of the insert 344 also includes a sidewall cushioning element 382 that increases the thickness of a selected sidewall 364 of the insert 344 (FIG. 5).

It will be understood that the form, and positioning, of the cushion elements 376 depends on the form and positioning of the selected surface 346, and also of the preselected portion 378 of the selected surface 346. It will also be understood that, although the preselected portion 378 is within the selected surface 346, the preselected portion 376 may occupy the entire selected surface 346. The preselected portion is an area on the surface(s) of the discharge end assembly 342 which is subjected to wear to a much greater extent than the surface areas of the discharge wall assembly that are adjacent to it. It is intended that the cushion elements 376 are formed and located (in the insert 344) to provide additional protection from wear to the preselected portion(s) 378.

Figure 2B:
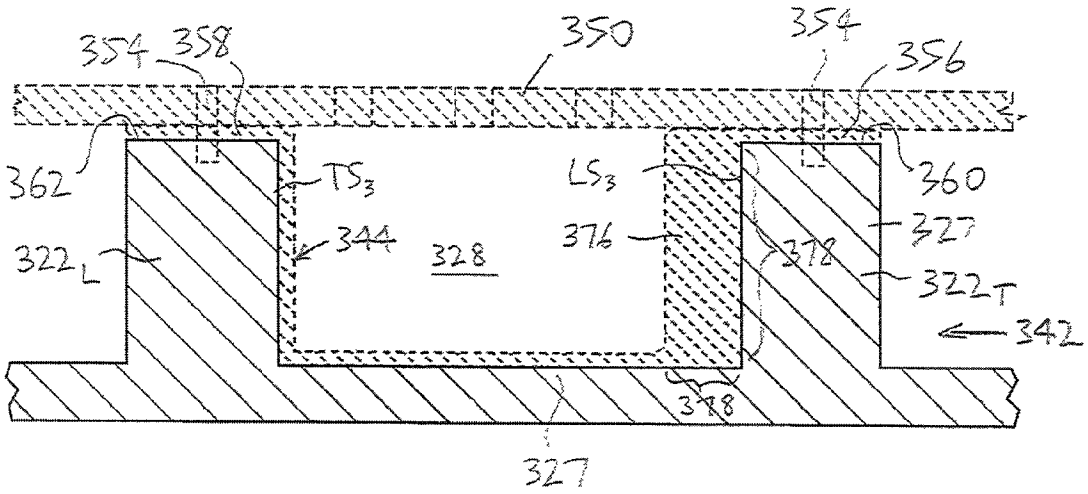
FIG. 2B is a cross-section taken along line B-B in FIG. 2A, drawn at a larger scale.

For example, the insert 344 illustrated in FIG. 4D has at least two cushion elements, identified by reference numerals 380 and 382 respectively. It can be seen that the cushion elements 380, 382 are positioned in order to protect the right-hand side of the outer perimeter wall 326 (as presented in FIG. 4D), and generally the entire leading side "LS" of the trailing pulp lifter $\mathbf{322}_L$ (FIG. 5). As can be seen in FIG. 2B, the pulp lifter insert 344 has a profile selected to attenuate the wear to which the selected portion has been subjected. Preferably, the cushion elements are included in the insert 344 which is formed when the preselected portion of the selected surface 346 is an area of excessive wear in a discharge end assembly 342 (FIG. 2A). For the purposes hereon, "excessive wear" means that the preselected portion 378 is worn to a greater extent than the balance of the selected surface, or selected surfaces located elsewhere in the discharge end assembly 342.

For example, in FIG. 2B, the insert 344 is shown secured in the predetermined position therefor, in a pulp chamber 328. The cushion element 376 is shown as being located adjacent to the preselected portion 378 on the leading pulp lifter $\mathbf{322}_L$ for the pulp chamber 328. It can also be seen that the selected surface 346 includes not only the preselected portion 378, but also parts of a discharge end wall 327 and the trailing pulp lifter, identified as $\mathbf{322}_L$ in FIGS. 2B and 2C for clarity of illustration. However, as can also be seen in FIG. 2B, the preselected portion 378 also includes a part of the discharge end wall 327.

Figure 2C:
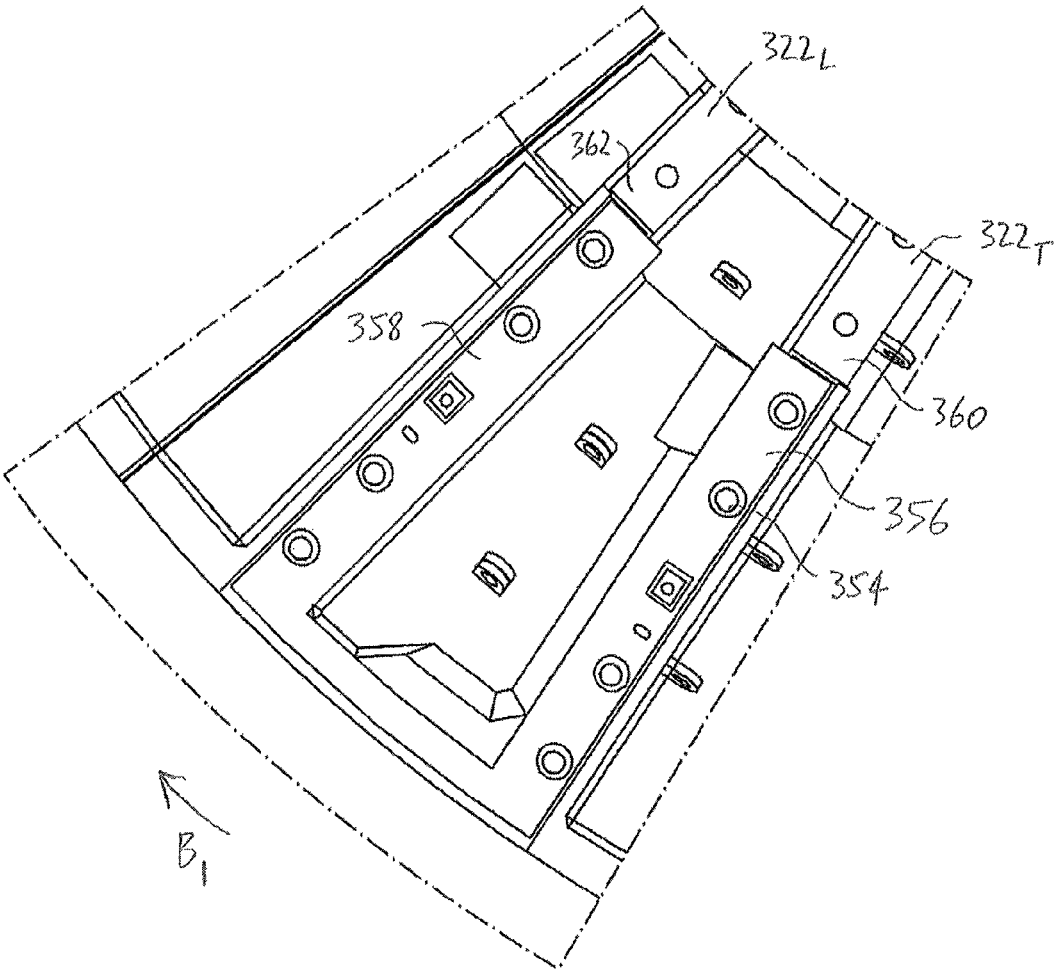
FIG. 2C is a part of the discharge end wall assembly of FIG. 2A, drawn at a larger scale.

It is preferred that the insert 344 includes flanges 356, 358 that are located between a discharge grate 350 and respective ridge surfaces 360, 362 of the pulp lifters 322, 322' when the insert 344 is in the predetermined position therefor (FIGS. 2B, 2C). Preferably, and as shown in FIG. 2B, the discharge grate 350 is secured to the discharge end assembly 342 by fasteners 354. (The discharge grate 350 is omitted from FIG. 2C for clarity of illustration.) Those skilled in the art would appreciate that the fasteners 354 preferably are those used to secure the discharge grate 350 to the pulp lifters in the absence of the insert 344, i.e., the insert 344 is conveniently retrofitted using pre-existing elements of the discharge grate and the discharge end assembly 342.

In FIG. 2A, a number of the inserts 344 are shown mounted in the discharge end assembly 342. The direction of rotation is indicated by arrow "$B_1$". It will be understood that discharge grates are omitted from FIG. 2A for clarity of illustration. As can be seen in FIG. 2A, which is exemplary only, there are several pulp chambers 328 in which the insert 344 is not installed. The flanges 356, 358 can also be seen in FIGS. 4D and 5. In the example illustrated in FIG. 2A, the wear to which the discharge end assembly 342 is subjected has resulted in the pattern of installed inserts 344 that is shown therein. Also, for clarity of illustration, the inserts 344 that are shown in FIG. 2A are substantially the same. As noted above, however, each of the inserts 344 preferably is tailored for the wear patterns in each individual pulp chamber.

Figure 4E:
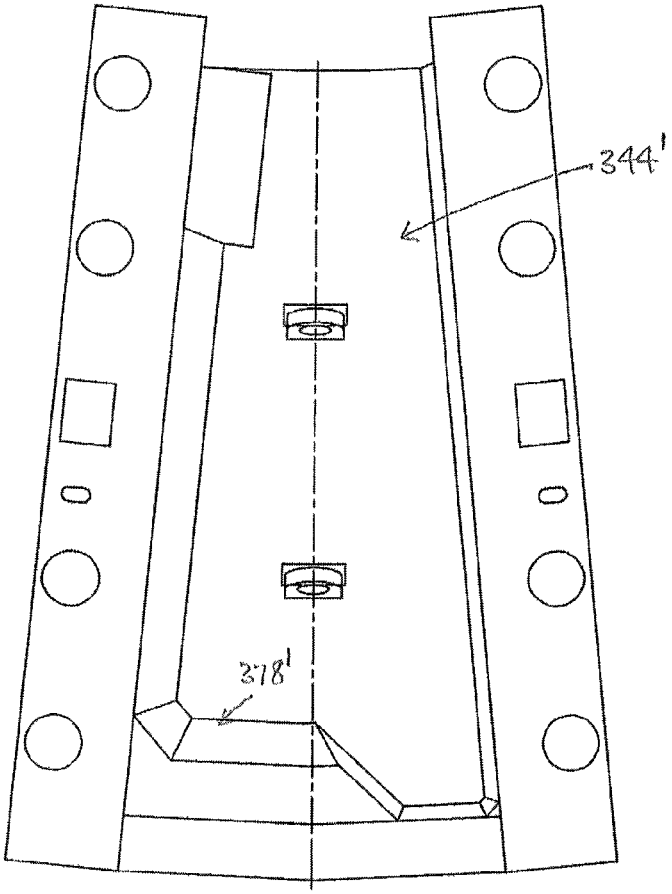
FIG. 4E is a top view of another alternative embodiment of the insert of the invention.

An example of an insert 344' that is formed to include one or more cushion elements 378' in a different configuration is shown in FIG. 4E. As can be seen in FIG. 4E, in this embodiment, the cushion elements 378' are located on the left-hand side of the insert 344', as illustrated. Those skilled in the art would appreciate that the locations, shape and dimensions of the cushion elements on the insert may vary as required, depending on the pattern of wear on the discharge end assembly.

As can be seen in FIG. 5, to install the insert 344 (shown in FIGS. 4D and 5) in the pulp chamber 328, the insert 344 is moved into the pulp chamber 328 (as indicated by arrow "F"). In one embodiment, the pulp chamber insert 344 preferably includes sidewalls 364 and an end wall 366 connected to a floor portion 368 thereof.

For convenience, in FIG. 5, the leading pulp lifter relative to the pulp chamber 328 associated therewith is identified by reference numeral $\mathbf{322}_L$, and the trailing pulp lifter is identified by reference numeral $\mathbf{322}_T$. When the pulp chamber insert 344 is in the predetermined position relative to the selected surface 346, the floor portion 368 engages the discharge end wall 327, the sidewalls 364 engage the trailing side "$TS_3$" of the leading pulp lifter $\mathbf{322}_L$ and the leading side "$LS_3$" of the trailing pulp lifter $\mathbf{322}_T$ respectively, and the end wall 366 engages the outer perimeter wall 326. Also, the flanges 356, 358 engage the ridge surfaces 360, 362 of the trailing and leading pulp lifters $\mathbf{322}_T$, $\mathbf{322}_L$ respectively. It will be understood that openings 370 in the flanges 356, 358 align with the holes 372 in the ridge surfaces 360, 362 to permit insertion of the fasteners 364 (not shown in FIG. 5) therethrough, to secure the discharge grate 350 to the discharge end assembly 342 and also to secure the insert 344 in the predetermined position therefor.

Figure 3:
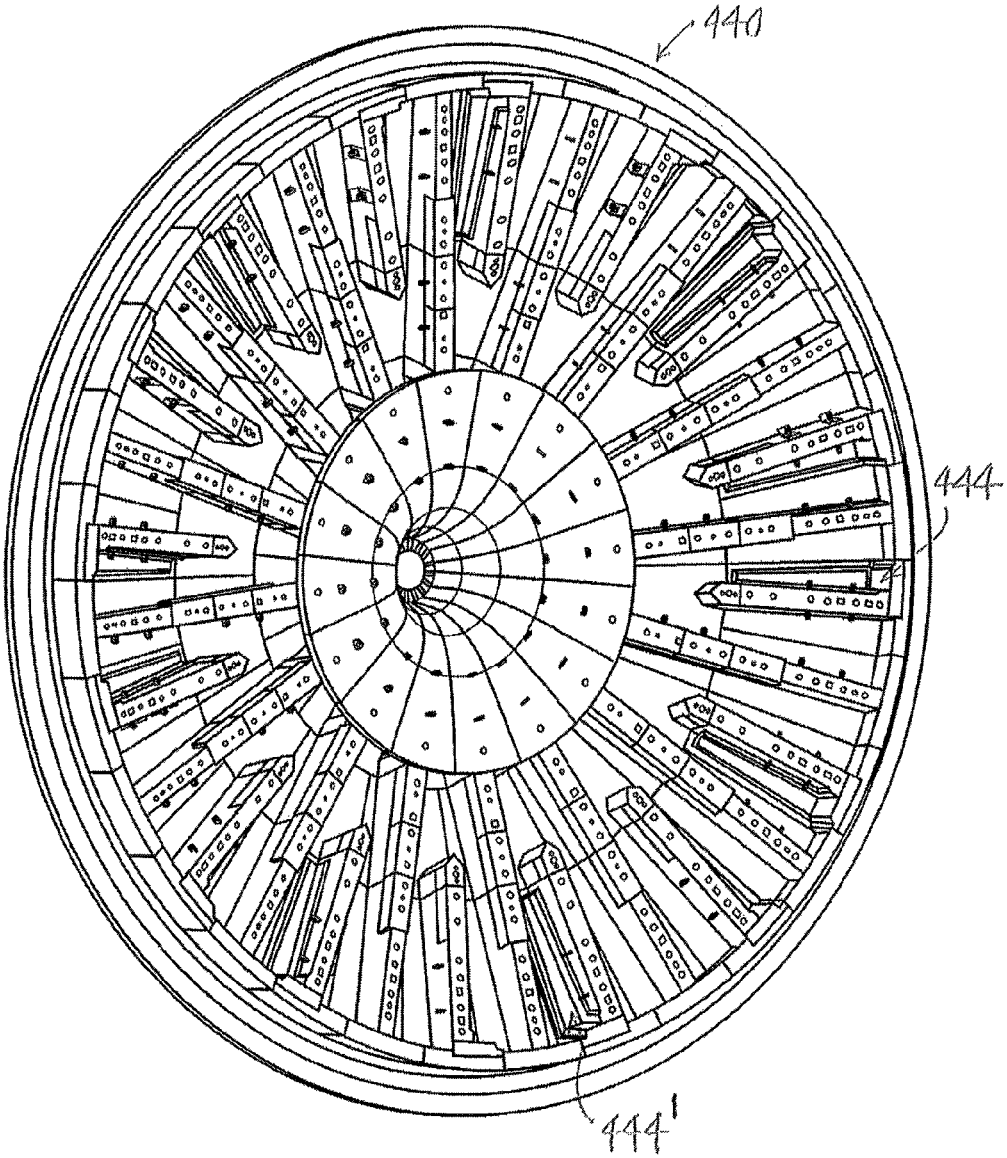
FIG. 3 is an isometric view of the discharge end wall assembly of FIG. 2A, drawn at a smaller scale.
Figure 6A:
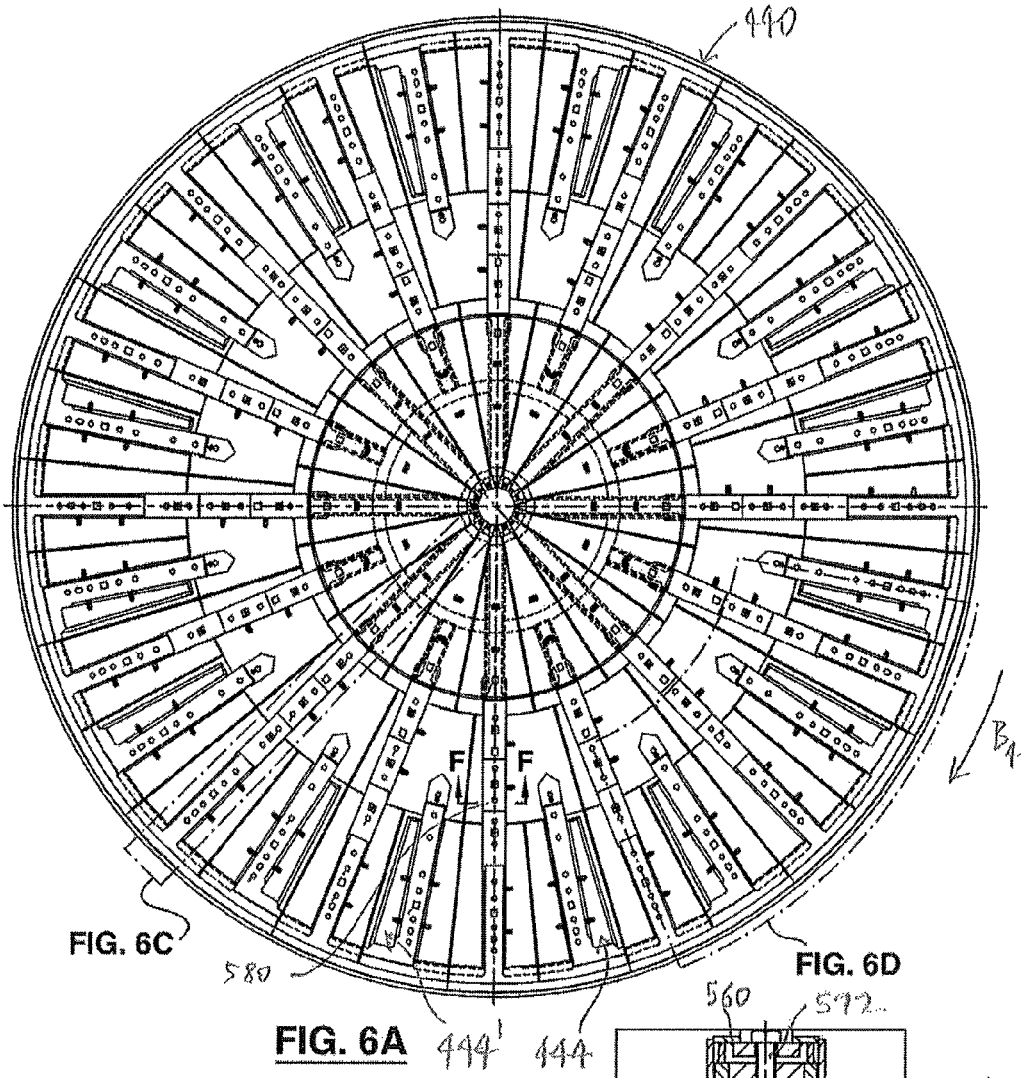
FIG. 6A is an elevation view of an alternative embodiment of a discharge end wall assembly of the invention, drawn at a smaller scale.
Figure 6B:
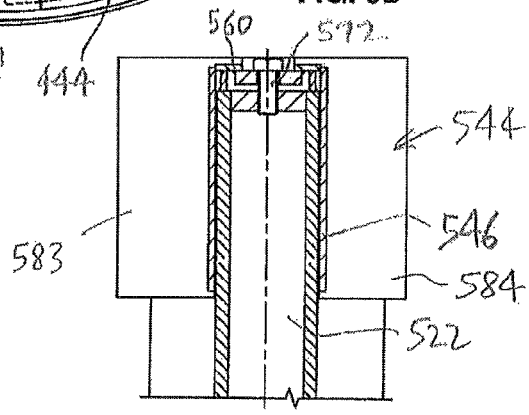
FIG. 6B is a cross-section taken along line D-D in FIG. 6A, drawn at a larger scale.
Figure 6C:
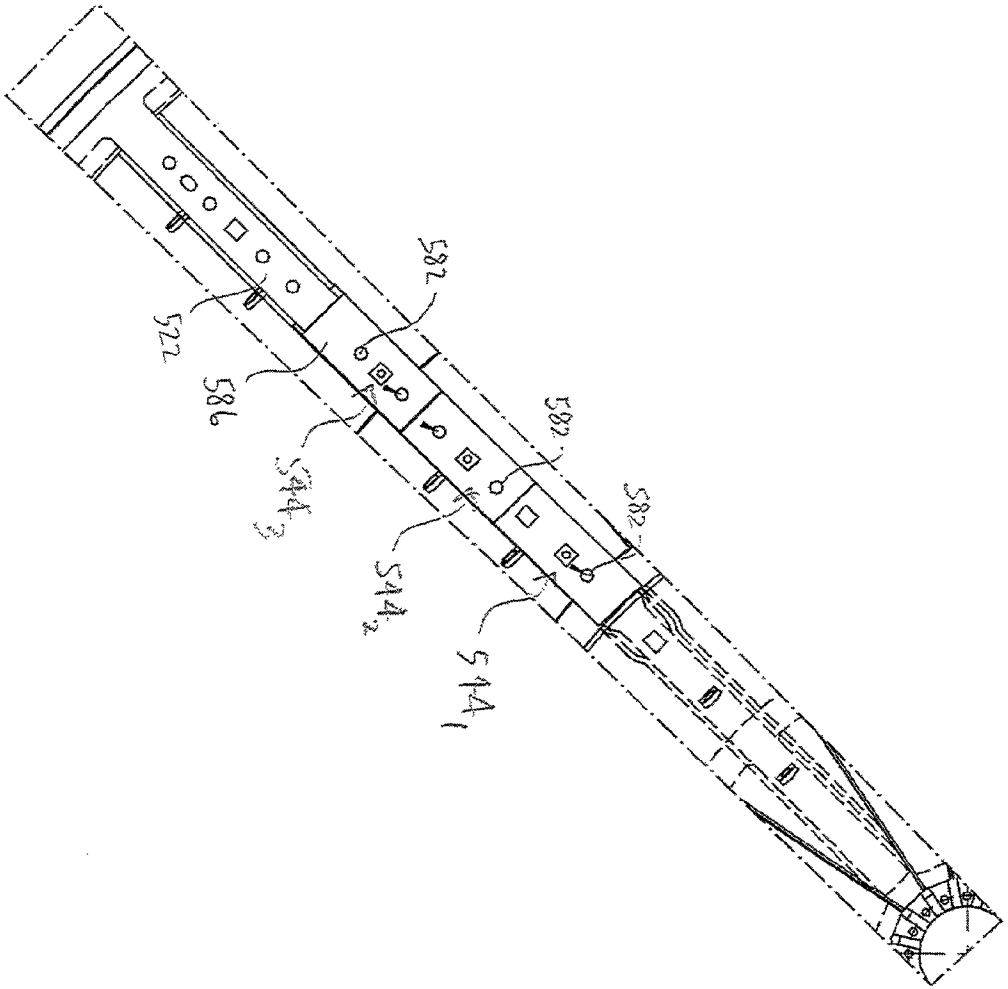
FIG. 6C is an elevation view of a pulp lifter of the discharge end wall assembly of FIG. 6A, drawn at a larger scale.
Figure 6D:
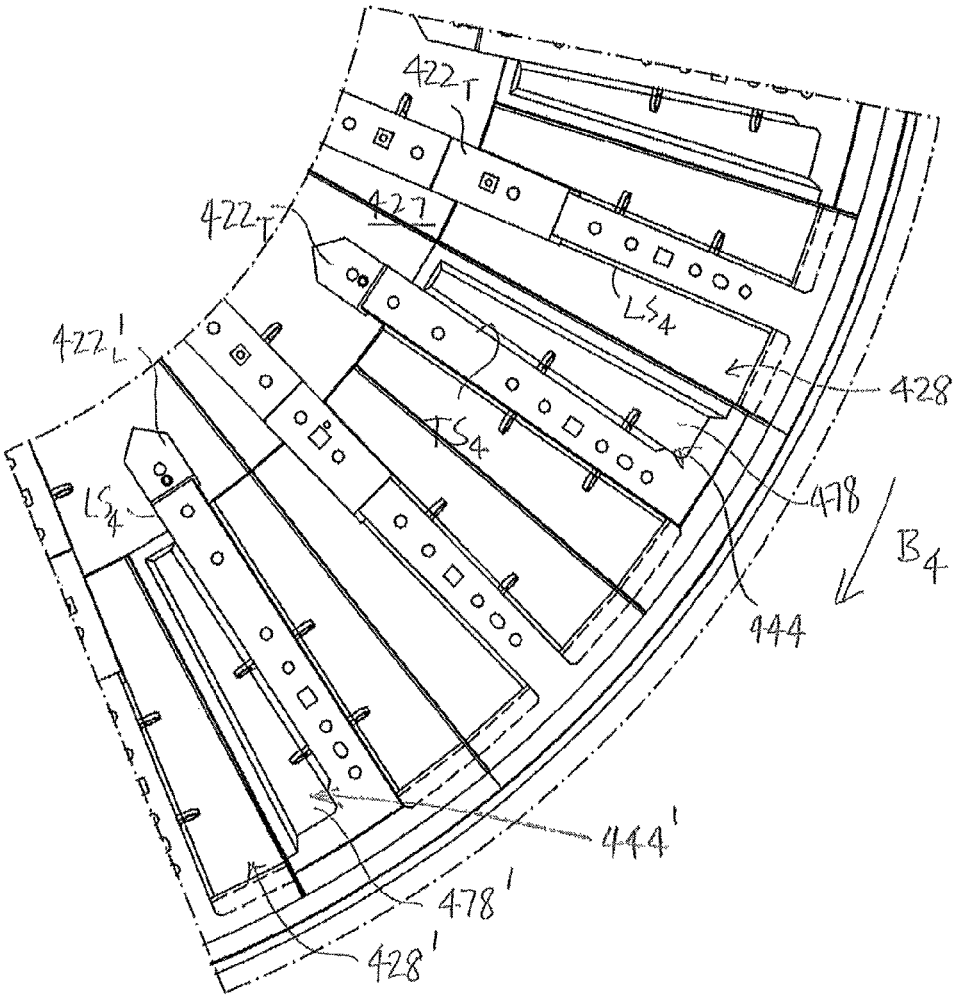
FIG. 6D is an elevation view of a portion of the discharge end wall assembly of FIG. 6A, drawn at a larger scale.

Another alternative embodiment of an insert 444 of the invention is illustrated in FIGS. 3, 6A, and 6D. As can be seen in FIG. 6D, the insert 444 preferably includes a cushion element 478 that covers a portion of a discharge end wall 427 that is adjacent to a trailing side "$TS_4$" of a leading pulp lifter $\mathbf{422}_L$. (The direction of rotation is shown by arrow "$B_4$" in FIG. 6D.) The insert 444 is mounted in a pulp chamber 428.

Another embodiment of the insert, referred to by reference numeral 444' for clarity of illustration, is also illustrated in FIG. 6D. As can be seen in FIG. 6D, the insert 444' preferably includes a cushion element 478' that covers a portion of the discharge end wall that is adjacent to a leading side "$LS_4$" of a trailing pulp lifter $\mathbf{422}_T$'. For clarity of illustration, the pulp chamber in which the insert 444' is installed is identified by reference numeral 428'.

A discharge end wall system 440 including the inserts 444 and 444' is illustrated in FIGS. 3 and 6A.

Figure 1B:
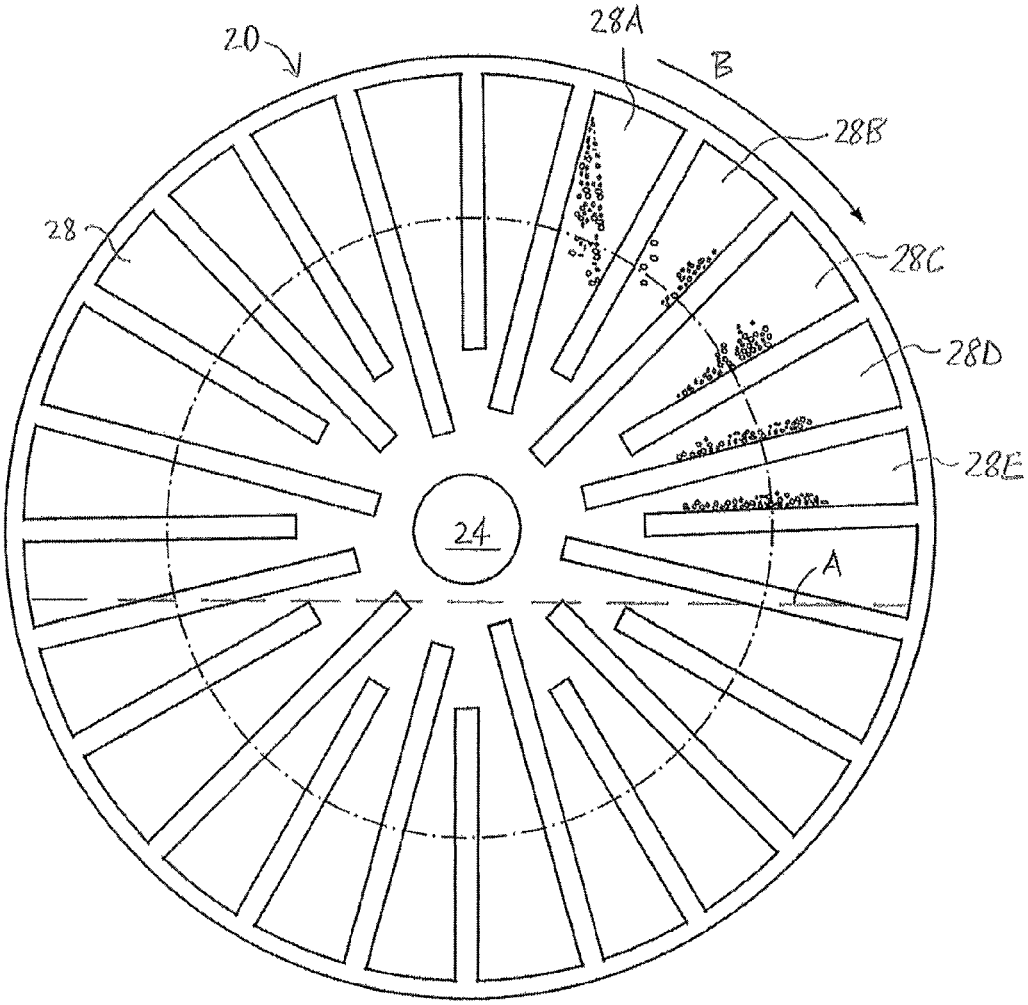
FIG. 1B (Prior Art)
FIG. 1B (also described previously) is a schematic illustration of the pulp chambers of FIG. 1A and the selected solid particles therein further along the rotation path.
Figure 1C:
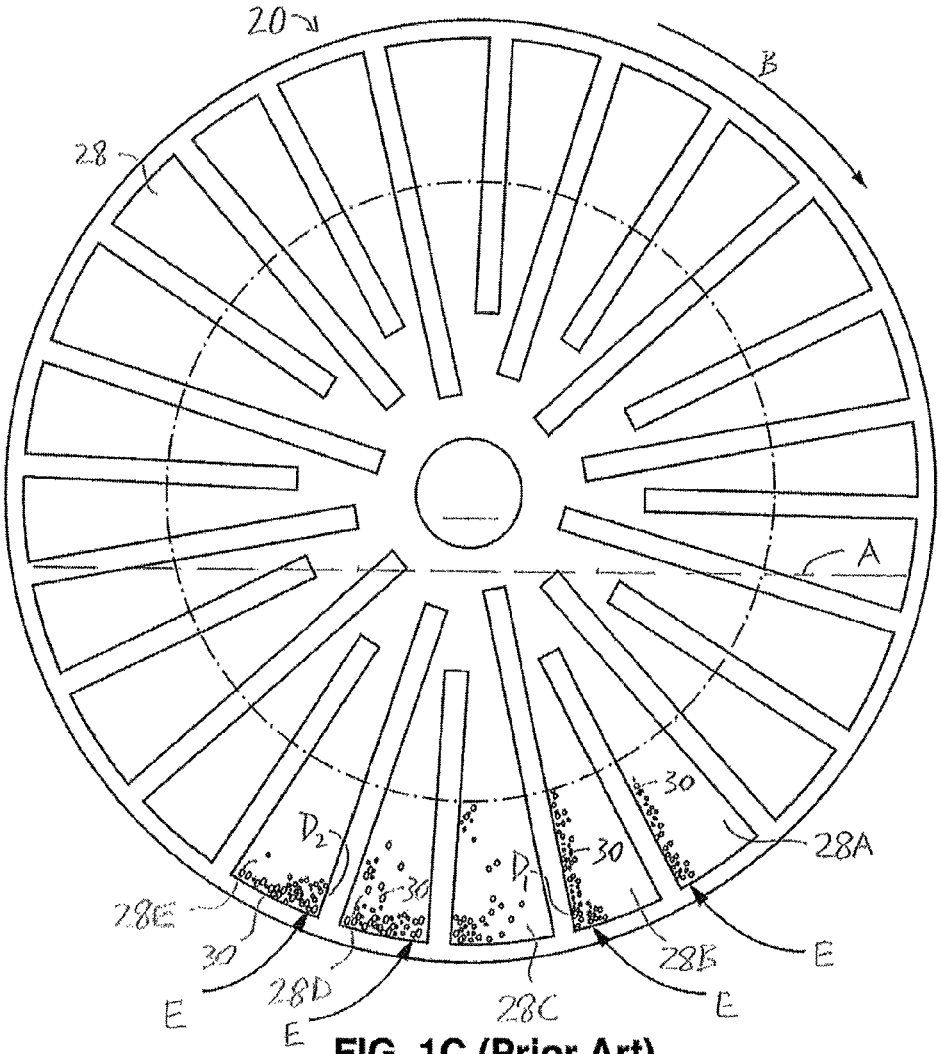
FIG. 1C (Prior Art)
FIG. 1C (also described previously) is a schematic illustration of the pulp chambers of FIGS. 1A and 1B and the selected solid particles therein further along the rotation path.
Figure 1D:
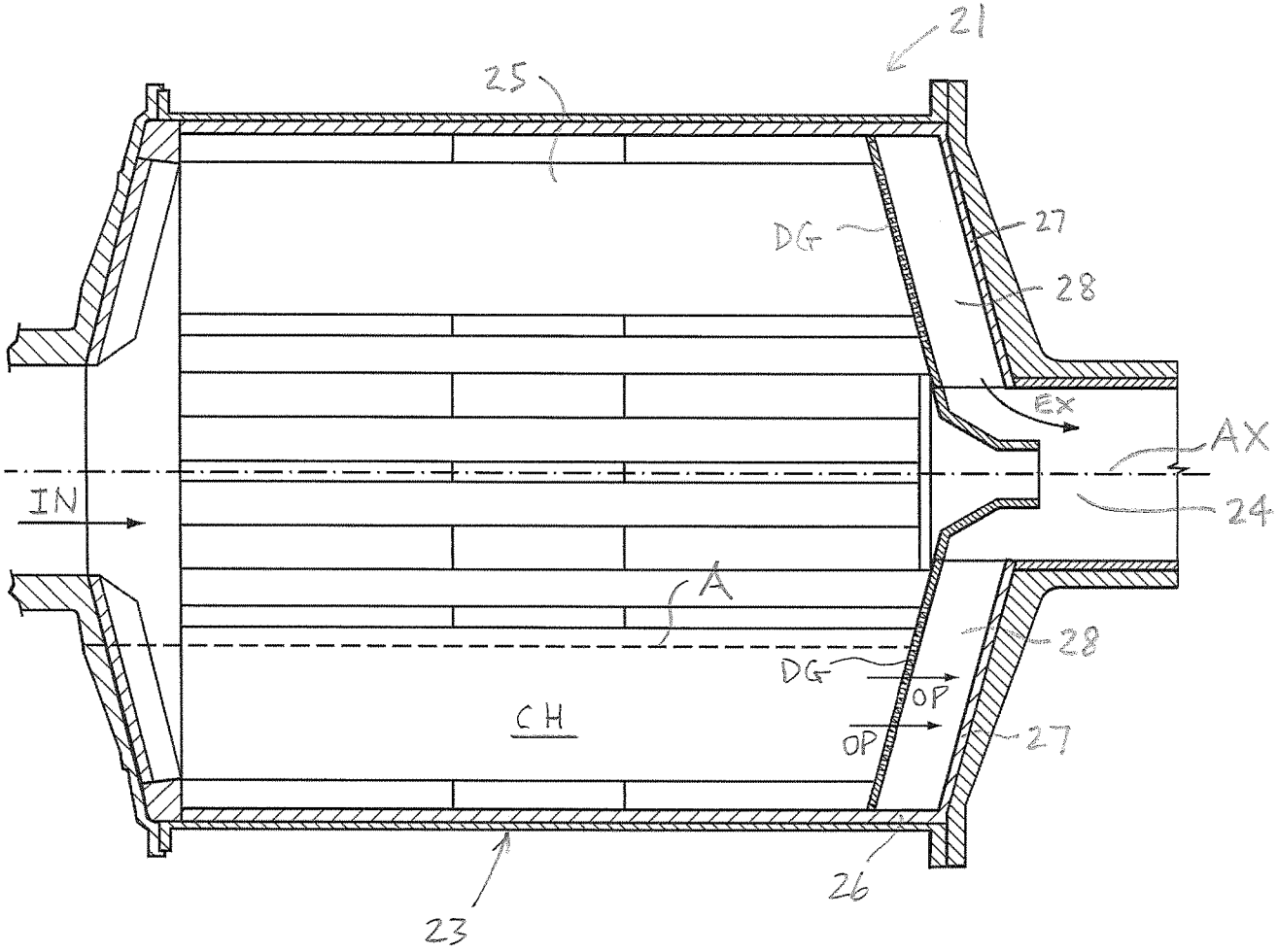
FIG. 1D (Prior Art)
FIG. 1D (also described previously) is a longitudinal cross-section of a conventional grinding mill, drawn at a smaller scale.

As can be seen in FIGS. 1A-1C, the intermediate regions of the pulp lifters may be subjected to wear, to a significant extent. Also, and as illustrated in FIG. 1A, an inner end of the pulp lifter may be subjected to wear. The pulp lifters are particularly subjected to wear on their trailing sides, although there would also be wear on the leading side of each pulp lifter, due in part to the ore particles and water that enter the pulp chamber when it is immersed in the charge, in each rotation. Accordingly, in certain situations, the pulp lifters or certain parts thereof appear to be subjected to wear, while other elements of the discharge end assembly are subjected to much less wear. In these circumstances, the insert may be formed to fit onto the pulp lifter, in a sleeve-like arrangement.

Accordingly, a selected surface 546 may be located only on a selected one of the pulp lifters 522. An embodiment of an insert 544 of the invention is formed to fit onto a selected one of the pulp lifters 522 to cover the selected surface 546 of the selected one of the pulp lifters 522, to mitigate the extent to which the selected surface 546 is subjected to wear (FIG. 6B).

An embodiment of an insert 544 of the invention is illustrated in FIGS. 6A, 6B, and 6C, positioned on the pulp lifter 522 at an intermediate location 580. FIG. 6B is a cross-section taken along line F-F in FIG. 6A. As can be seen in FIG. 6B, in one embodiment, the insert 544 preferably includes an aperture 582 (FIG. 6C) alignable with a hole 572 in a ridge surface 560 of the pulp lifter 522, to enable the insert 544 to be secured to the pulp lifter 522 by a fastener (not shown in FIG. 6B) at the intermediate location.

In one embodiment, the insert 544 preferably includes side elements 583, 584 (FIG. 6B) that are joined to a central element 586 (FIG. 6C). Preferably, the aperture 582 is formed in the central element 586.

Those skilled in the art would appreciate that the insert 544 preferably is also held in place by a discharge grate (not shown in FIGS. 6A, 6B, 6C) which preferably is positioned on and engaged with the central element 586. The fasteners (not shown) otherwise used to hold the discharge grate on the pulp lifter preferably are positioned in the aperture and the hole to secure the grate to the pulp lifter 522, with the central element 586 of the insert 544 located therebetween.

In FIG. 6C, three inserts (identified for convenience as $\mathbf{544}_1$, $\mathbf{544}_2$, and $\mathbf{544}_3$) are shown positioned on the pulp lifter 522. In the example illustrated in FIG. 6C, parts of the pulp lifter 522' that are positioned inwardly and outwardly relative to the inserts $\mathbf{544}_1$, $\mathbf{544}_2$, and $\mathbf{544}_3$ are not covered by inserts.

It will also be understood that the insert 544 may have any suitable length. The thickness or thicknesses of the insert 544, and its length and shape, are determined according to the circumstances in the particular grinding mill in which the cap is installed.

For instance, in one embodiment, the pattern of wear on a particular intermediate portion of a particular pulp lifter preferably is taken into account in determining the length of the insert 544 that is to be positioned on such intermediate portion, and also the thickness (or thicknesses, as the case may be) of the insert 544. Other parameters may also be taken into account. It will be understood that, depending on the pattern of wear, forming the insert 544 to have different thicknesses thereof in view of the wear pattern may be optimal. It will also be understood, however, that it may be found to be optimal not to have the insert 544 positioned on every intermediate portion of every pulp lifter in a particular grinding mill.

Preferably, the insert 544 is made of any suitable highly wear-resistant material or materials. In much the same way as described above in relation to the pulp chamber insert, the material or materials are selected according to a number of factors, related, e.g., to the grinding mill and the charge, among other things. For instance, the insert 544 may be made of metallic or non-metallic material or materials.

The insert 544 protects intermediate portions of the pulp lifters, ultimately resulting in the pulp lifters have longer operational lives than would otherwise have been achieved. From the foregoing, it can also be seen that the insert 544 can be replaced relatively easily when the discharge grates are replaced.

From the foregoing, it can be seen that the invention preferably includes an embodiment of the grinding mill of the invention that includes one or more of the pulp chamber inserts 244 (FIG. 7).

In one embodiment, the grinding mill 221 preferably includes the mill shell 223 having the mill shell chamber 225 therein (FIG. 7) and having an outer perimeter wall 226 partially defining the discharge end wall 227 of the mill shell 229, rotatable in a direction of rotation to produce the pulp including ore particles and water. The discharge end wall 227 has a central hole 224 therein through which the pulp exits the mill shell 223. The discharge wall assembly 242 preferably includes the discharge end wall 227 and the outer perimeter wall 226 and a number of the pulp lifters 228 mounted on the discharge end wall 227. As described above, the pairs of adjacent ones of the pulp lifters respectively including the leading one of the pulp lifters in the pair and the trailing one of the pulp lifters in the pair relative to the direction of rotation. The pairs partially define respective pulp chambers therebetween through which the pulp is at least partially directed to the central hole. Also, the grinding mill includes the inserts 244, for covering the selected surface 246 of the discharge wall assembly 242, to mitigate wear to which the selected surface is subjected by movement of the pulp in the pulp chambers.

Figure 8:
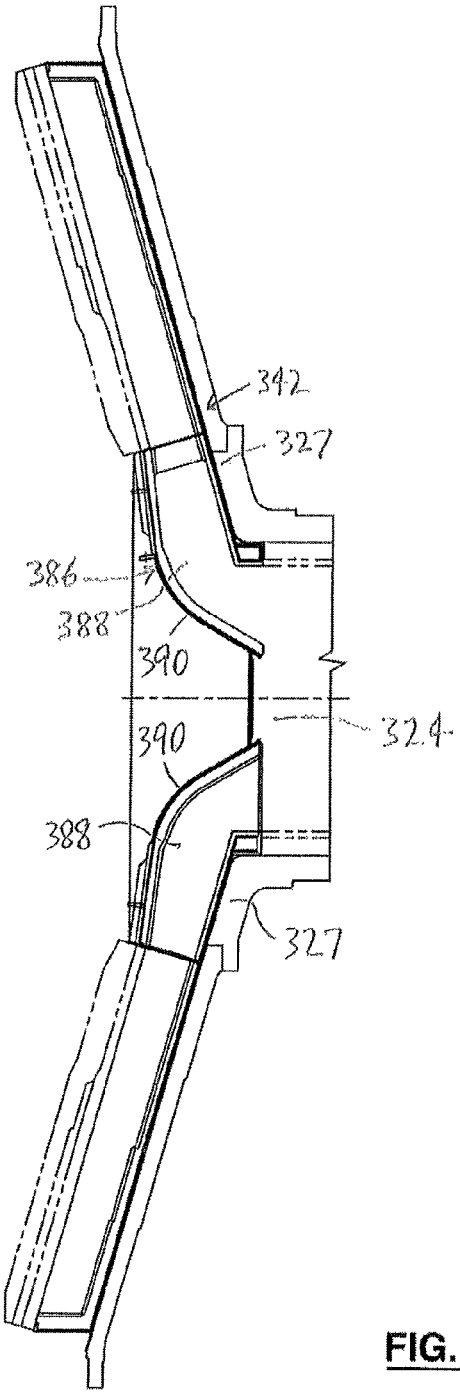
FIG. 8 is a cross-section of the discharge end wall assembly of FIG. 2A taken along line C-C in FIG. 2A.

As can be seen in FIGS. 2A and 8, in one embodiment, the discharge wall assembly 342 preferably additionally includes a cone portion 386 for directing the pulp toward the central hole 324. The cone portion includes a number of vanes 388 radially aligned with selected ones of the pulp lifters 322, each vane 388 being mounted to the discharge end wall 327 and including an outer edge 390 thereof distal to the discharge end wall that at least partially defines an arc curved such that each of the vanes 388 directs the pulp toward the central hole 324.

INDUSTRIAL APPLICABILITY

Preferably, the insert is formed and installed in the discharge end assembly according to the following steps. First, the selected surface, being one of the surfaces in the discharge end assembly that is subjected to wear, is selected. It will be understood that the surfaces are selected based on the extent to which they are subjected to wear during the operation of the grinding mill. One way to assess which surfaces are subjected to more wear than others is a visual inspection of the discharge end assembly after operation for a period of time. Such visual inspection may be conducted, for instance, when discharge grates are removed in connection with routine maintenance. Next, the insert preferably is formed to cover the selected surface when positioned in the predetermined position relative to the selected surface, to mitigate the wear to which the selected surface is subjected. The discharge grate positioned between the mill shell chamber and the discharge end assembly is removed, to expose the selected surface. Preferably, the insert is positioned in the predetermined position therefor to cover the selected surface. The insert is secured in the predetermined position on the discharge end assembly.

Those skilled in the art would appreciate that the order in which the steps of one embodiment of the method of the invention are described above is not determinative, and certain of the steps may be performed in a sequence other than as set out above. For example, the discharge grate may first be removed, and following that, the selected surfaces may be selected.

In another embodiment of the method of the invention, first, a number of surfaces are selected. Next, a number of inserts preferably are formed to cover identified ones of the selected surfaces respectively, each insert being tailored to cover the identified ones of the selected surfaces respectively. As described above, the selected surfaces may have different shapes and sizes, and may be located in different locations of the discharge end assembly. Accordingly, it is preferred that the inserts for a particular discharge end assembly are respectively formed for specific (identified ones of the) selected surfaces. It is preferred that each insert is positioned in the predetermined position therefor respectively to cover the identified ones of the selected surfaces. Each of the tailored inserts preferably is secured in the predetermined position therefor respectively.

It is also preferred that each insert is secured in the predetermined position therefor by locating a portion of the insert between the discharge grate and the discharge end assembly, and attaching the discharge grate to the discharge end assembly, as described above.

In an alternative embodiment, the insert preferably includes one or more cushion elements formed to be located adjacent to one or more preselected portions of the selected surface when the insert is in the predetermined position therefor, to attenuate the extent to which the preselected portion is subjected to wear. As described above, the preselected portion may be, for example, a part of the surface of the discharge end assembly that is subjected to wear to a greater extent than the other parts of the selected surface(s).

In summary, the invention provides one or more inserts for covering the selected surface(s) of the discharge end assembly including the discharge end wall of a mill shell partially defined by the outer perimeter wall thereof and a number of pulp lifters mounted on the discharge end wall. The insert preferably is formed to cover the selected surface to mitigate wear to which the selected surface is subjected when the insert is located in the predetermined position relative to the selected surface.

In one embodiment, the insert is formed to fit into the pulp chamber. The pulp chamber insert preferably includes a floor, for covering a part of the discharge end wall, one or more sidewalls connected to the floor, for covering predetermined parts of the leading and trailing sides of the respective trailing and leading pulp lifters, and an end wall, for covering a part of the outer perimeter wall. The insert is formed to mitigate the extent to which the preselected part of the discharge end wall, the predetermined parts of the leading and trailing sides of the trailing and leading pulp lifters respectively, and the part of the outer perimeter wall are subjected to wear due to movement of the pulp in the pulp chamber, when the insert is positioned in the predetermined position.

In another embodiment, the insert is a sleeve insert formed to be positioned in the predetermined position therefor on the pulp lifter to cover the selected surface of the pulp lifter, for mitigating wear to which the selected surface is subjected.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A discharge end wall system mounted on a discharge end wall of a mill shell in a grinding mill, the mill shell being rotatable about an axis of rotation thereof in a direction of rotation to produce a pulp including ore particles and water, the discharge end wall being partially defined by an outer perimeter wall of the mill shell and having a central hole through which the pulp exits the mill shell, the discharge wall system comprising:

a discharge end assembly comprising:

the discharge end wall and the outer perimeter wall;

a plurality of pulp lifters radially arranged on the discharge end wall relative to the axis of rotation;

pairs of adjacent ones of the pulp lifters each respectively comprising a leading one of the pulp lifters in the pair and a trailing one of the pulp lifters in the pair relative to the direction of rotation, said pairs partially defining respective pulp chambers therebetween through which the pulp is at least partially directed to the central hole; and at least one insert formed to be positioned in a selected one of the pulp chambers for covering at least one selected surface of the discharge end assembly in the selected one of the pulp chambers, to mitigate the extent to which said at least one selected surface is subjected to wear due to movement of the pulp in the pulp chambers;

said at least one insert comprising a pair of flanges formed for engagement with ridge surfaces of the pair of the pulp lifters that partially define the selected one of the pulp chambers in which said at least one insert is positioned, each said flange comprising at least one opening therethrough alignable with at least one hole in respective ridge surfaces of the pair of pulp lifters that partially define the selected one of the pulp chambers;

at least one discharge grate configured to be positioned on the pulp lifters, said at least one discharge grate comprising apertures therein to permit the pulp to flow therethrough into the pulp chambers;

said at least one insert being securable in a predetermined position in the selected one of the pulp chambers to cover said at least one selected surface therein, by at least one fastener received through said at least one opening in each said flange and into said at least one hole in the respective pulp lifters that partially define the selected one of the pulp chambers; and said at least one insert comprising at least one cushion element formed to be positioned adjacent to at least one preselected portion of said at least one selected surface of the outer perimeter wall of the pulp chamber and formed to provide protection from wear thereof when said at least one insert is positioned in the selected one of the pulp chambers.

2. A grinding mill comprising:

a mill shell comprising a mill shell chamber therein and having an outer perimeter wall partially defining a discharge end wall of the mill shell, rotatable in a direction of rotation to produce a pulp including ore particles and water;

the discharge end wall having a central hole therein through which the pulp exits the mill shell;

a discharge end assembly comprising:

the discharge end wall and the outer perimeter wall;

a plurality of pulp lifters mounted on the discharge end wall, pairs of adjacent ones of the pulp lifters respectively comprising a leading one of the pulp lifters in the pair and a trailing one of the pulp lifters in the pair relative to the direction of rotation, said pairs partially defining respective pulp chambers therebetween through which the pulp is at least partially directed to the central hole;

at least one insert formed to be positioned in a selected one of the pulp chambers for covering at least one selected surface of the discharge end assembly in the selected one of the pulp chambers, to mitigate wear to which said at least one selected surface is subjected by movement of the pulp in the pulp chambers;

said at least one insert comprising a pair of flanges formed for engagement with ridge surfaces of the pair of the pulp lifters that partially define the selected one of the pulp chambers in which said at least one insert is positioned, each said flange comprising at least one opening therethrough alignable with at least one hole in respective ridge surfaces of the pair of pulp lifters that partially define the selected one of the pulp chambers;

at least one discharge grate configured to be positioned on the pulp lifters, said at least one discharge grate comprising apertures therein to permit the pulp to flow therethrough into the pulp chambers;

said at least one insert being securable in a predetermined position in the selected one of the pulp chambers to cover said at least one selected surface therein, by at least one fastener received through said at least one opening in each said flange and into said at least one hole in the respective pulp lifters that partially define the selected one of the pulp chambers, and said at least one insert comprising at least one cushion element formed to be positioned adjacent to at least one preselected portion of said at least one selected surface of the outer perimeter wall of the pulp chamber and formed to provide protection from wear thereof when said at least one insert is positioned in the selected one of the pulp chambers.

3. A method of installing at least one insert in a discharge end assembly including a discharge end wall of a mill shell, the mill shell defining a mill shell chamber therein, the discharge end wall being partially defined by an outer perimeter wall of the mill shell and having a central hole through which the pulp exits the mill shell, the discharge end assembly including a plurality of pulp lifters radially arranged on the discharge end wall relative to the axis of rotation, pairs of adjacent ones of the pulp lifters each respectively including a leading one of the pulp lifters in the pair and a trailing one of the pulp lifters in the pair relative to the direction of rotation, said pairs partially defining respective pulp chambers therebetween through which the pulp is at least partially directed to the central hole, the method comprising the steps of:

(a) selecting at least one selected surface in the discharge end assembly that is subjected to wear;

(b) forming said at least one insert to be positioned in a selected one of the pulp chambers for covering said at least one selected surface of the discharge assembly in the selected one of the pulp chambers, to mitigate the extent to which said at least one selected surface is subjected to wear due to movement of the pulp in the pulp chambers, said at least one insert comprising a pair of flanges formed for engagement with ridge surfaces of the pair of the pulp lifters that partially define the selected one of the pulp chambers in which said at least one insert is positioned, each said flange comprising at least one opening therethrough alienable with at least one hole in respective ridge surfaces of the pair of pulp lifters that partially define the selected one of the pulp chambers, said at least one insert comprising at least one cushion element formed to be positioned adjacent to at least one preselected portion of said at least one selected surface of the outer perimeter wall of the selected one of the pulp chambers and formed to provide protection from wear thereof, when said at least one insert is positioned in the selected one of the pulp chambers;

(c) removing at least one discharge grate positioned between the mill shell chamber and the discharge end assembly to expose said at least one selected surface, said at least one discharge grate being configured to be positioned on the pulp lifters, said at least one discharge grate comprising apertures therein to permit the pulp to flow therethrough into the pulp chambers;

(d) positioning said at least one insert in the predetermined position to cover said at least one selected surface; and (e) with at least one fastener received through said at least one discharge grate and said at least one opening in each said flange respectively and into said at least one hole in the respective pulp lifters, securing said at least one insert in the predetermined position in the selected one of the pulp chambers.

* * * * *